US007735402B2

(12) United States Patent
Tsuji et al.

(10) Patent No.: US 7,735,402 B2
(45) Date of Patent: Jun. 15, 2010

(54) PUNCHING APPARATUS

(75) Inventors: Masaru Tsuji, Nara (JP); Jinichi Nagata, Osaka (JP); Hideo Yoshikawa, Nara (JP); Hidetoshi Kaneko, Nara (JP); Kouzou Yamaguchi, Nara (JP); Masayuki Nagatani, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 244 days.

(21) Appl. No.: 11/812,130

(22) Filed: Jun. 15, 2007

(65) Prior Publication Data

US 2007/0295178 A1 Dec. 27, 2007

(30) Foreign Application Priority Data

Jun. 22, 2006 (JP) ..... 2006-173066
Jun. 22, 2006 (JP) ..... 2006-173067

(51) Int. Cl.
*B26F 1/00* (2006.01)

(52) U.S. Cl. ..... 83/166; 83/684

(58) Field of Classification Search ..... 83/166, 83/684

See application file for complete search history.

(56) References Cited

U.S. PATENT DOCUMENTS 3,636,408 A * 1/1972 Shuman ..... 361/212
4,352,143 A * 9/1982 Uno ..... 361/221
4,742,742 A * 5/1988 Yokoe ..... 83/101
7,588,617 B2 * 9/2009 Kyllonen et al. ..... 55/477

FOREIGN PATENT DOCUMENTS

| | | |
|---|---|---|
| JP | 02-023384 | 1/1990 |
| JP | 11-255417 | 9/1999 |
| JP | 2002-200592 A | 7/2002 |
| JP | 2003-232671 | 8/2003 |
| JP | 2004-098243 | 4/2004 |
| JP | 2006-116662 A | 5/2006 |
| JP | 2006-151613 A | 6/2006 |

* cited by examiner

*Primary Examiner*—Kenneth E. Peterson
(74) *Attorney, Agent, or Firm*—Nixon & Vanderhye, PC

(57) ABSTRACT

In one embodiment, a charge removal member 120, which removes static electricity built up on paper waste 130, is disposed in a collecting container 63 used for collecting the punch waste 130 generated by punching transported paper. The charge removal member 120 is disposed in an open top portion of the collecting container 63, in a location corresponding to a hole-punching punch 64 disposed in the punching unit 60, with a proximal end portion 121 of the charge removal member 120 supported by the collecting container 63 and the distal end portion of the charge removal member 120 forming charge removal comb-shaped needles 122 extending towards the central portion of the collecting container.

8 Claims, 20 Drawing Sheets

PUNCHING APPARATUS

CROSS REFERENCE TO RELATED APPLICATIONS

This Application claims priority rights under Section 119(a) of the U.S. Patent Law from Japanese Patent Application No. 2006-173066 and Japanese Patent Application No. 2006-173067 filed on Jun. 22, 2006 in Japan. Their entire contents are incorporated herein by reference.

BACKGROUND OF THE TECHNOLOGY

1. Field of the Technology

The present technology relates to a punching apparatus for performing a paper finishing operation disposed along a transport path used for transporting image-formed (printed) paper to a stacking location in a discharge portion.

2. Description of the Related Art

When images are printed on transported paper in a conventional image forming apparatus, image information is transferred onto the paper in a transfer portion by rendering electrostatic latent images formed on an electrostatic latent image carrier (photosensitive drum) visible using a developer (toner) and transporting the paper to the location of the transfer process using timing that ensures coordination between the leading edge of the paper and the leading edge of the image information on the photosensitive drum.

In recent years, following the development of color image forming apparatuses, and the increase in the printing speed of image forming apparatuses, highly efficient transfer techniques have been required in the transfer process. At present, methods frequently used in the transfer process include methods such as "corona charger", "roller transfer", "brush transfer", "belt transfer", and the like, with each of these methods employing a technique, in which a toner image electrically attracted to the surface of a photosensitive drum is transferred to paper by applying, to the respective members, a transferring electric field (of 1-3 kV or so) having a polarity opposite that of the electrostatic polarity of the developer (toner). The paper, to which such a transferring electric field is applied, is charged by the electric field that transfers toner images from the photosensitive drum to the paper.

Moreover, the transported paper are tribocharged as a result of rubbing against a number of transport rollers, paper guides, etc. disposed between the paper feed portion and the discharge portion, such that it is common for the discharged paper to carry approximately 1-2 kV of static electricity when printing is complete. When multiple sheets of the thus electrostatically charged paper are discharged into a discharge tray portion, there is a chance that repulsing electric fields may be generated between the sheets of the paper and may bring about a stacking failure in the discharge tray portion.

Accordingly, to eliminate such problems, it has been proposed to position a destaticizing brush, which is an electroconductive brush, in the vicinity of the discharge rollers (for example, see JP H02-23384A (hereinafter referred to as "Patent Document 1")).

Moreover, recently, many apparatuses have been developed that employ the "belt transfer" method, in which a transfer belt is utilized to reliably transport transported paper to the transfer portion, where the transfer process is performed. In the belt transfer method, an endless belt with a predetermined resistance value is supported by multiple rollers, and a transfer region, which is termed "transfer nip", is formed between the photosensitive drum and one of the supporting rollers or a roller between the supporting rollers.

In the belt transfer method used to carry out such a transfer process, the number of electric fields applied to the transfer belt is larger in comparison with conventional methods such as "corona charger", "roller transfer", and "brush transfer". Namely, it requires an "attracting field", which attracts transported paper to the transfer belt, a "transfer field", which is indispensable for the transfer process, a "separating field", which separates paper from the transfer belt in order to smoothly transport the adhered paper bearing the transferred images to the next process, etc.

Thus, in an image forming apparatus employing the belt transfer method in the transfer process, in the transfer process, paper are subjected to the influence of the above-described multiple electric fields as well as to the tribocharging by transport rollers etc. along the transport path. Moreover, in a printing mode (i.e. color printing mode) that requires not one pass, but two or more passes along the transport path during printing, paper are affected by the above-mentioned various electric fields as many times as the paper goes through the transfer process and along the transport path.

Table 1 lists results obtained by measuring the charge of transported paper upon completion of printing in such various printing modes.

TABLE 1

Electrostatic Charge of Transported Paper

| | Electrostatic Charge of Paper At Time of Discharge (kV/sheet) (Paper Type: A4) |
|---|---|
| Pseudo Printing (duplex printing) (Printing density: 0%) | 1.0-1.5 |
| Monochromatic Printing (duplex printing) | 2.0-3.5 |
| Color Printing (duplex printing) | 4.0-6.5 |

As can be seen from Table 1, color printing produces incomparably higher levels of electrostatic charge in paper than in case of pseudo printing or monochromatic printing.

As concerns the paper discharged in such a state, as a way of making image forming apparatuses multi-functional, a growing number of recently developed apparatuses are equipped with a finishing unit, in which printed paper is subjected to a finishing process. Stapling, punching, and saddle-stitching operations including bookbinding, as well as filing, etc. are carried out during the finishing process.

Punch waste is produced from the punched paper when paper electrostatically charged in the above-described manner undergo punching during the finishing process. In this case, when the punch waste does not carry static electricity, it falls naturally into a holding container for punch waste disposed below, due to its own gravity etc. and accumulates in it in a natural manner. However, punch waste that carries static electricity does not fall naturally into the collecting container and sticks to the surface of the walls etc. of the container due to the action of static electricity.

The resulting state is illustrated in FIG. 17. As shown in FIG. 17, punch waste 130 adhered to a fullness detecting sensor 102 disposed on the wall etc. of the container leads to frequent misdetection by the fullness detecting sensor 102, which detects that the container is full despite the fact that the amount of waste collected in a collecting container 63 does not make it full. Moreover, blocking phenomena (bridging phenomena) may occur as a result of contact between chads 130 adhered to the walls of the container and voids 150 may also be created inside the collecting container 63. The problem arising in such a case is that the fullness detecting sensor 102 may end up detecting fullness before the appropriate amount of waste is collected in the container (before it is full) because of the punch waste 130 piling up on top of them. In addition to that, another problem that may arise is that the punch waste 130 carrying static electricity may be scattered outside the container and may stick to the inside of the apparatus when the collecting container is taken out and put in.

Accordingly, technologies have been proposed for eliminating such problems (for example, see JP H11-255417A (hereinafter referred to as "Patent Document 2") and JP 2003-232671A (hereinafter referred to as "Patent Document 3")).

As described in Patent Document 2, a punch waste storage container is vibrated using a punch waste vibrator apparatus in order to flatten the pile of punch waste. Moreover, Patent Document 3 describes providing support means for supporting, in a vertically movable manner, punch waste collecting means for receiving punch waste, and detection means for detecting the lowered position of the punch waste collecting means that descends as the weight of the punch waste collected thereon increases, and, after the punch waste collecting means has descended to a predetermined position, detecting that the punch waste collecting means is fully loaded with punch waste.

The technologies described in the above-mentioned Patent Document 1, 2, etc. are effective when the tribocharge of the transported paper is small, such as when the image forming apparatus is a low-speed apparatus, when the printing mode is monochromatic printing, etc. In other words, a corresponding effect can be expected in case the tribocharge is 1-2 kV or so, as described in the above-mentioned conventional technologies.

However, as described above, image forming apparatuses have increased in speed in recent years, and, moreover, when the belt transfer method is used in the transfer process, as shown in Table 1, the electrostatic charge of the paper increases and even if the punch waste storage container is vibrated as described in Patent Document 2, it is impossible to throw off all the chads adhered to the container walls etc.

Moreover, when paper are discharged to the discharge tray, their static electricity is removed because according to the technology described in Patent Document 1a destaticizing brush is disposed on the downstream side of the discharge rollers. However, it is still a problem that, when a finishing process is added, strong shearing forces generated by the action of the hole-punching punch during the punching operation produce a tribocharge in the punch waste, with the punch waste adhering to the container walls etc. and causing the fullness detecting sensor to erroneously detect fullness.

In addition, because the technology described in Patent Document 3 detects substantially the weight of the punch waste collecting means (punch waste collecting container) alone, the possibility of fullness misdetection is eliminated even if the punch waste does carry static electricity and adheres to the container walls etc. However, the problem is that, unlike a conventional fullness detecting sensor, this technology requires a mechanism for vertically moving the punch waste collecting means and a detection sensor for detecting the descent of the punch waste collecting means, which makes the construction used for conducting the punching process more complicated and at the same time ends up increasing component cost. Moreover, yet another problem is that apparatus miniaturization will be limited, too, because its construction becomes more complicated.

SUMMARY OF THE TECHNOLOGY

It is an object of the present technology to provide a punching apparatus capable of reliably causing punch waste to fall to, and accumulate in, the bottom of a collecting container by directly removing static electricity from the punch waste generated by punching.

The punching apparatus of the present technology is a punching apparatus disposed along a transport path for image-formed paper, including a collecting container for collecting punch waste generated by punching the image-formed paper, and a charge removal member disposed in the collecting container and removing static electricity built up on the punch waste.

The charge removal member is preferably disposed in a location corresponding to the hole-punching punch disposed in the punching apparatus.

In the collecting container disposed underneath the hole-punching punch, a photo coupler of the reflective or transmissive type is disposed on the surface of its upper inner wall, with said photo coupler used to detect whether the container is full of punch waste. Accordingly, the charge removal member is disposed in the portion of the collecting container that is above the location where the photo coupler is disposed. Specifically, the charge removal member may be disposed in the open top portion of the collecting container.

For instance, the charge removal member may be disposed on the collecting container such that the proximal end portions of the charge removal member is supported on the opposite edges of the open top portion of the collecting container and the distal end portions of the charge removal member extend towards the central portion of the collecting container.

In addition, the distal end portions of the charge removal member may be constituted by charge removal needles formed in a pectinate shape. Preferably, the charge removal needles are arranged at a spacing permitting capture of the punch waste. Namely, they are preferably arranged at a spacing permitting reliable capture of the punch waste punched out of paper and allowing it to fall down between the charge removal needles after charge removal.

Furthermore, the spacing density of the charge removal needles in the portion corresponding to the hole-punching punch may be higher than the spacing density of the charge removal needles in the portion corresponding to the periphery of the hole-punching punch. By disposing the needles in this manner, electrostatically charged punch waste is reliably captured in the high-density portion and prevented from being scattered to other areas of the collecting container, and, after destaticizing the punch waste collected on the charge removal needles, the punch waste is allowed to fall under its own gravity through the low-density portion.

It should be noted that the charge removal member is grounded through the frame of the apparatus.

In the thus configured punching apparatus, disposing the charge removal member removing static electricity built up on punch waste in the collecting container for collecting punch waste generated by punching transported paper makes it possible to directly remove static electricity from the punch waste and, as a result, reliably cause the punch waste to fall to, and accumulate in, the bottom of the collecting container without scattering the punch waste.

Alternatively, the punching apparatus of the present technology is a punching apparatus disposed along a transport path for image-formed paper, including a hole-punching punch used for punching image-formed paper, and a charge removal member disposed in the range of movement of the hole-punching punch and removing static electricity built up on punch waste generated in the process of punching.

Specifically, the charge removal member may comprise, for example, a main body portion having an opening and multiple charge removal needles extending from the main body portion towards the center portion of the opening, and in the process of punching, the hole-punching punch may pass through the opening while pushing punch waste generated by the punching, as a result of which the punch waste and the hole-punching punch would come into contact with the charge removal needles.

The hole-punching punch may perform punching by descending downwardly through a through-hole formed in paper guides forming a paper transport path, with the main body portion of the charge removal member secured to the underside of the paper guides in such a manner that the through-hole is aligned with the opening. As a result, when the hole-punching punch descends, both said hole-punching punch and punch waste punched out by the hole-punching punch come into contact with the charge removal needles, thereby enabling built-up static electricity to be removed not only from the punch waste, but also from the hole-punching punch as well.

Because such a configuration reliably destaticizes the punch waste punched from paper, the punch waste can fall naturally into the punch waste collecting container disposed below. In addition, since the hole-punching punch itself is also destaticized, when the hole-punching punch moves up through the hole punched in the paper after a hole-punching stroke, the paper do not get attracted to the hole-punching punch under the action of static electricity and punch hole deformation, etc. can be prevented.

In addition, because the present technology employs a configuration, in which the charge removal needles of the charge removal member are arranged to protrude into the range of movement of the hole-punching punch, the protrusion length of the charge removal needles presents a problem.

Namely, when the length of protrusion is considerable, the distal end portions of the charge removal needles entrained by the distal end of the hole-punching punch during its downward travel enter the space formed by the hole-punching punch and the punching dies, which may cause damage to the charge removal needles and malfunction of the punching apparatus. For this reason, it is preferable to set the length of protrusion of the charge removal needles in such a manner that the distal ends of the charge removal needles do not enter the above-mentioned space when the hole-punching punch descends to the lowermost position and enters the space between the punching dies.

Likewise, when the length of protrusion of the charge removal needles is considerable, the distal ends of the charge removal needles entrained by the distal end of the hole-punching punch during its upward travel enter the space above the lower paper guide forming the paper transport path, i.e. the paper transport path, which may cause damage to the charge removal needles, damage to the paper, and a punching apparatus malfunction. For this reason, it is preferable to set the protrusion length of the charge removal needles such that they do not enter the space above the lower paper guide, i.e. the paper transport path.

In addition, when the length of protrusion of the charge removal needles is considerable, another problem to address is the fact that the charge removal needles are entrained by the upward travel of the hole-punching punch during the ascent of the hole-punching punch and undergo upwardly directed bending deformation. To eliminate such problems, the charge removal needles may be arranged in a curved shape, with their distal end portions hanging down or arranged at a downward slant. Disposing the needles in this manner makes the contact between the charge removal needles and hole-punching punch smoother and problems such as entrainment of the charge removal needles by the hole-punching punch during its upward travel under the action of contact pressure forces do not occur even if the length of the charge removal needles is rather long.

It should be noted that the charge removal member is grounded through the frame of the apparatus.

In the thus configured punching apparatus, disposing the charge removal member that removes static electricity built up on punch waste generated by punching in the range of movement of the hole-punching punch makes it possible to directly remove static electricity from the punch waste and, as a result, reliably cause punch waste to fall to, and accumulate in, the bottom of the collecting container without scattering the punch waste.

DESCRIPTION OF THE PREFERRED EMBODIMENTS

For a better understanding of the present technology, embodiments will be described below with reference to the accompanying drawings. It should be noted that the first embodiment and second embodiment described below represent examples that embody the present technology and by their nature do not limit the technical scope of the present technology.

First Embodiment

First of all, explanations will be provided regarding the first embodiment.

<Regarding Schematic Configuration of Multifunction Machine 1>

Figure 1:
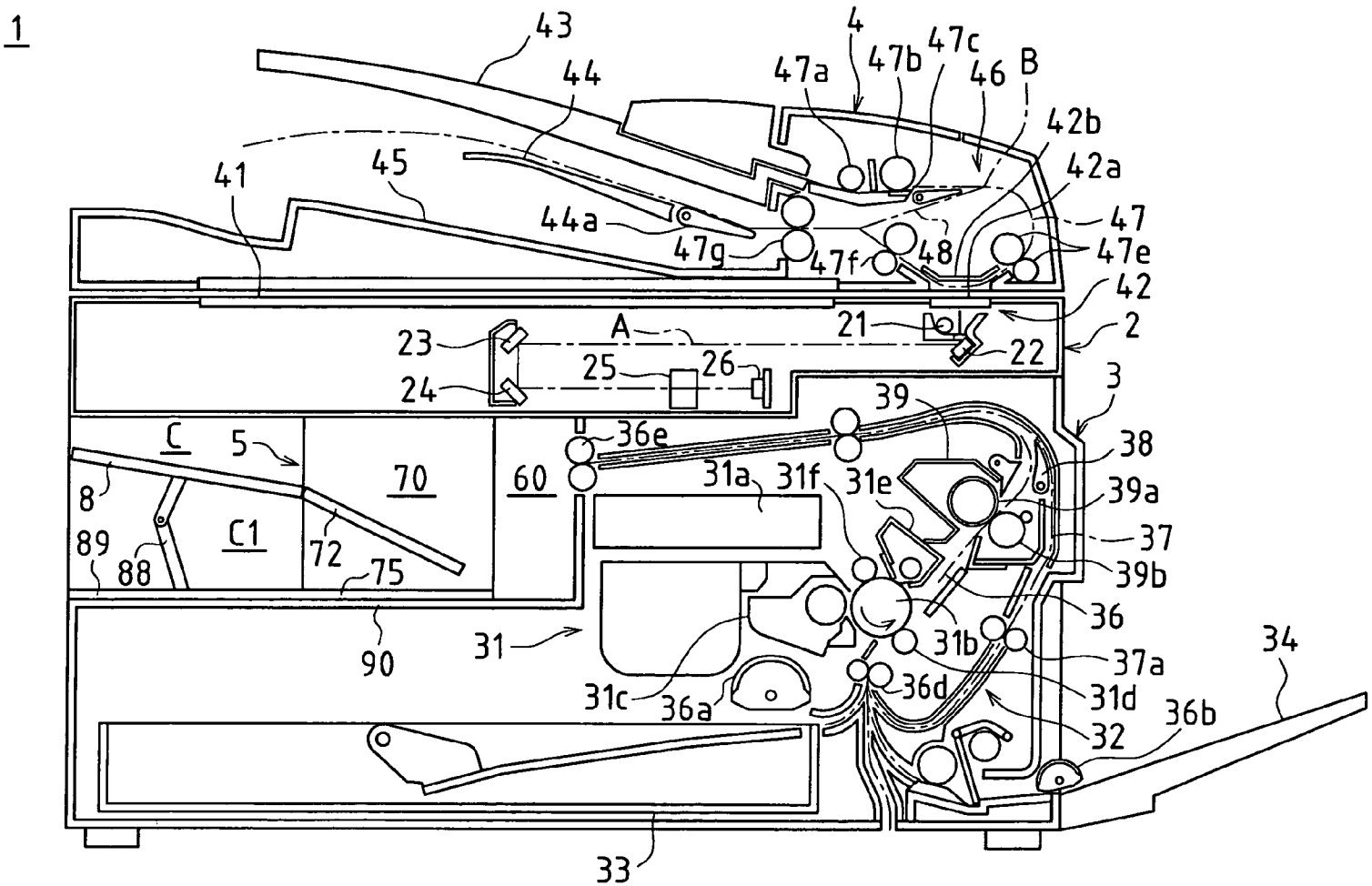
FIG. 1 is a view illustrating the schematic configuration of a multifunction machine, to which the present technology is applied.

The first embodiment describes the application of an image forming apparatus comprising a punching apparatus of the present technology to a multifunction machine. FIG. 1 shows an outline of the internal configuration of such a multifunction machine.

As shown in FIG. 1, the multifunction machine 1 comprises a scanner portion 2, which serves as original reading means, an image forming portion 3, an automatic original feed portion 4, and a paper finishing portion 5, which serves as paper finishing means. It should be noted that, for convenience, parts of the multifunction machine 1 other than the paper finishing portion 5 and a discharge tray 8 are hereinafter referred to as the "main body of the apparatus".

The image forming modes used by the multifunction machine 1 to form images on recording paper (including recording media such as overhead transparencies) include the copier mode, the printer mode, and the fax mode, with each one of the modes selected by the user. Each portion of the multifunction machine 1 is explained below.

First of all, explanations are provided regarding the scanner portion 2. The scanner portion 2 is a portion that creates original image data by reading images of originals placed on an original stage 41 made of transparent glass etc. and images of originals fed one sheet at a time by the automatic original feed portion 4. The scanner portion 2 comprises an exposing light source 21, multiple reflecting mirrors 22, 23, 24, an imaging lens 25, and a photoelectric transducer (CCD: Charge Coupled Apparatus) 26.

The exposing light source 21 illuminates an original placed on the original stage 41 of the automatic original feed portion 4 or an original transported via the automatic original feed portion 4. As shown by the alternate long and short dash line A in FIG. 1, the reflecting mirrors 22, 23, 24 are configured such that after light reflected from the original has been reflected leftward in FIG. 1, it is then reflected downward and to the right in FIG. 1, in the direction of the imaging lens 25.

The original image reading operation includes the following two situations. When reading an original placed on the original stage 41 (using the "stationary sheet system"), the exposing light source 21 and reflecting mirrors 22, 23, 24 scan the original stage 41 in a horizontal direction so as to read the image of the entire original. On the other hand, when reading an original transported via the automatic original feed portion 4 (using the "moving sheet system"), the exposing light source 21 and reflecting mirrors 22, 23, 24 stay in the locations indicated in FIG. 1 and read the image of the original as it passes through a hereinafter described original reading portion 42 in the automatic original feed portion 4.

Light reflected by the reflecting mirrors 22, 23, 24 and passing through the imaging lens 25 is guided to the photoelectric transducer 26 and, in this photoelectric transducer 26, the reflected light is converted to an electrical signal (original image data).

The image forming portion 3 will be explained next. The image forming portion 3 comprises an image forming system 31, which serves as printing means, and a paper transport system 32.

The image forming system 31 comprises a laser scanning unit 31*a* and a photosensitive drum 31*b*, which serves as a drum-type image carrier. The laser scanning unit 31*a* illuminates the surface of the photosensitive drum 31*b* with laser light based on the original image data obtained by conversion in the photoelectric transducer 26 or image data inputted from an external terminal apparatus etc. The photosensitive drum 31*b* rotates in the direction indicated by the arrow in FIG. 1, and an electrostatic latent image is formed on its surface as it is illuminated by laser light from the laser scanning unit 31*a*.

Moreover, in addition to the laser scanning unit 31*a*, disposed around the outer periphery of the photosensitive drum 31*b* are a development unit (development mechanism) 31*c*, a transfer unit (transfer mechanism) having a transfer roller 31*d*, a cleaning unit (cleaning mechanism) 31*e*, a charge removal unit, not shown, and a charging unit (charging mechanism) having a charging roller 31*f*, all of which are located successively around the periphery of the drum.

The development unit 31*c* uses toner (an image-developing substance) to develop electrostatic latent images formed on the surface of the photosensitive drum 31*b* and render them visible. The transfer roller 31*d* transfers toner images formed on the surface of the photosensitive drum 31*b* onto recording paper, which is used as a recording medium. The cleaning unit 31*e* removes toner remaining on the surface of the photosensitive drum 31*b* after toner transfer. The charge removal unit removes residual charge from the surface of the photosensitive drum 31*b*. The charging roller 31*f* charges the surface of the photosensitive drum 31*b* to a predetermined potential prior to formation of electrostatic latent images.

When an image is formed on the recording paper, the surface of the photosensitive drum 31*b* is charged to a predetermined potential by the charging roller 31*f* and the laser scanning unit 31*a* illuminates the surface of the photosensitive drum 31*b* with laser light based on the original image data. After that, the development unit 31*c* uses the toner to develop a visible image on the surface of the photosensitive drum 31*b* and the toner image is transferred onto the recording paper with the help of the transfer roller 31*d*. Furthermore, toner remaining on the surface of the photosensitive drum 31*b* is then removed by the cleaning unit 31*e* and, at the same time, residual charge is removed from the surface of the photosensitive drum 31*b* by the charge removal unit. This completes a single operational cycle of image forming operation (printing operation) on recording paper. By repeating this cycle, images can be continuously formed on multiple sheets of recording paper.

On the other hand, the paper transport system 32 transports recording paper held in a paper cassette 33, which serves as paper feed means, or recording paper placed on a manual paper feed tray 34 one sheet at a time for image forming by the image forming system 31 and, simultaneously, discharges image-formed recording paper via a hereinafter described paper finishing portion 5 into a discharge tray 8, which serves as paper discharge means. The discharge tray 8 is arranged above the paper cassette 33 and underneath the scanner portion 2. The discharge tray 8 will be described in detail below.

Figure 2:
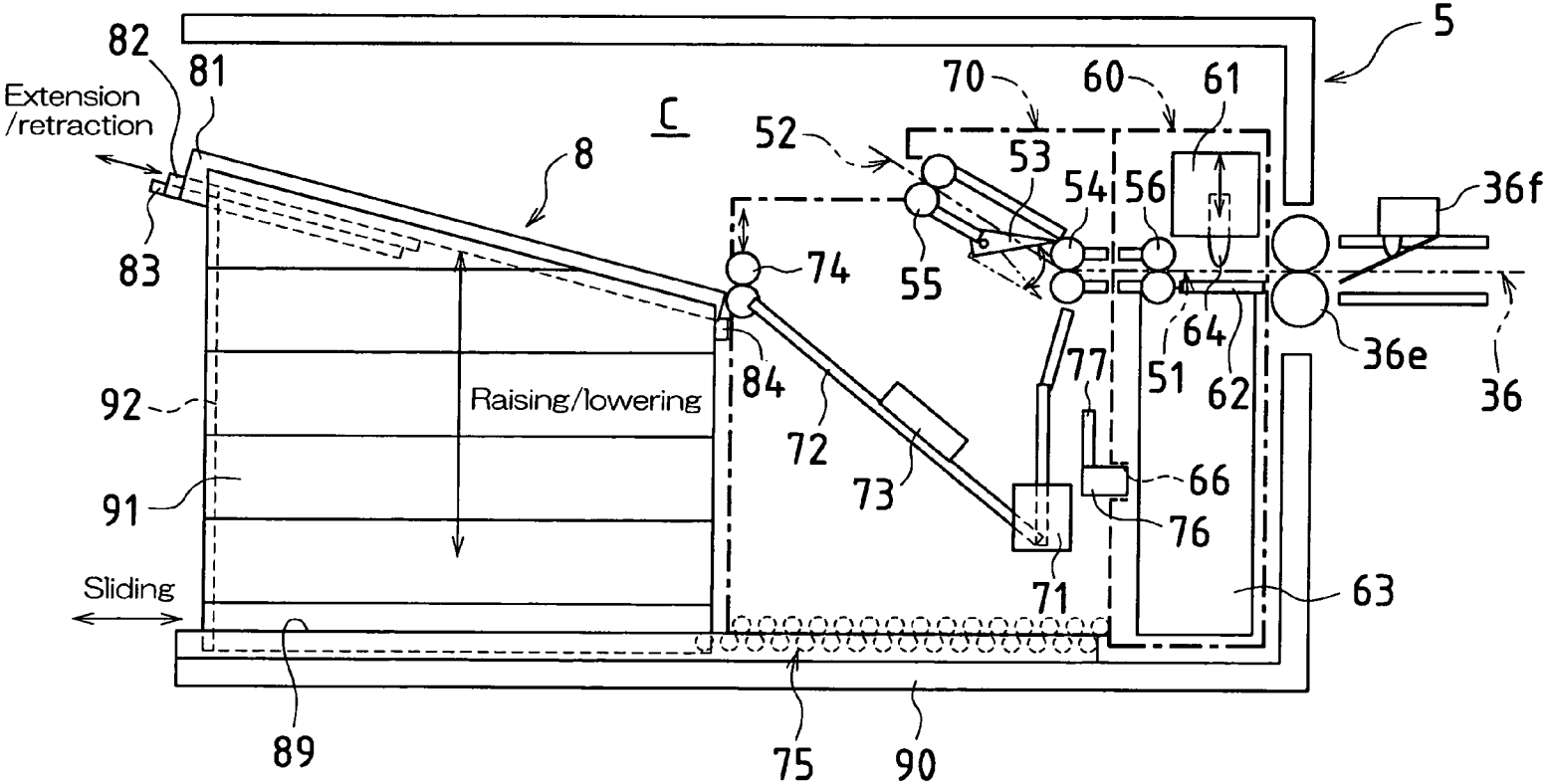
FIG. 2 is an explanatory view illustrating a schematic configuration of a paper finishing portion and discharge tray.

The paper transport system 32 comprises a main transport path 36 and a reverse transport path 37 situated in the main body of the apparatus, as well as a main transport path 51 and a switchback transport path 52 situated in the paper finishing portion 5, as shown in FIG. 2. The main transport path 36 in the main body of the apparatus and main transport path 51 in the paper finishing portion 5 are joined at the discharge rollers 36*e* in the main body of the apparatus. The main transport path 51 and switchback transport path 52 of the paper finishing portion 5 will be described below. In addition, in the multifunction machine 1, recording paper is transported through the paper transport system 32 using the so-called central reference system. In other words, recording paper is transported using the central position in the width direction (direction transverse to the transport direction of the recording paper) as a reference.

At one end, the main transport path 36 of the main body of the apparatus branches in two, with one of the branches facing the discharge side of the paper cassette 33 and the other branch facing the discharge side of the manual paper feed tray 34. In addition, at the other end, the main transport path 36 faces a punching unit (punching apparatus) 60 of the paper finishing portion 5. One of the ends of the reverse transport path 37 is joined to the main transport path 36 upstream from (in FIG. 1, below) the position where the transfer roller 31*d* is located, while its other end is joined to the main transport path 36 downstream from (in FIG. 1, above) the position where the transfer roller 31*d* is located.

A pickup roller 36*a* of a semi-circular cross-section is located at one end of the branches (the portion facing the discharge side of the paper cassette 33) of the main transport path 36. The rotation of the pickup roller 36*a* enables recording paper stored in the paper cassette 33 to be intermittently fed sheet-by-sheet to the main transport path 36. Likewise, a pickup roller 36*b* of a semi-circular cross-section is located at the other branch (the portion facing the discharge side of the manual paper feed tray 34) of the main transport path 36. The rotation of the pickup roller 36*b* enables recording paper placed on the manual paper feed tray 34 to be intermittently fed sheet-by-sheet to the main transport path 36.

Registration rollers 36*d* are located upstream from the position where the transfer roller 31*d* is located in the main transport path 36. The registration rollers 36*d* transport recording paper while aligning the position of the recording paper with toner image on the surface of the photosensitive drum 31*b*.

A fixing unit 39, which comprises a pair of rollers used for fixing transferred toner images on recording paper under heating, i.e. a hot roller 39*a* and a pressure roller 39*b*, is located downstream from the position where the transfer roller 31*d* is located in the main transport path 36. Furthermore, discharge rollers 36*e*, which are used for discharging recording paper into the paper finishing portion 5, are located at the boundary with the main transport path 51 of the paper finishing portion 5 at the downstream end of the main transport path 36.

A branch catch 38 is located at the connecting point between the upstream end of the reverse transport path 37 and the main transport path 36. The branch catch 38 is pivotable about a horizontal axis between a paper discharge position shown in FIG. 1 (position indicated by the solid line) and a paper reversal position, which is reached by the branch catch 38 pivoting, in FIG. 1, in the counterclockwise direction to open the reverse transport path 37. When the branch catch 38 is in the paper discharge position, recording paper is transported to the main transport path 51 of the paper finishing portion 5, and when it is in the paper reversal position, recording paper can be fed to the reverse transport path 37.

Transport rollers 37*a* are located in the reverse transport path 37 and, when recording paper switched back via the switchback transport path 52 in the paper finishing portion 5 is fed to the reverse transport path 37, the recording paper is transported by the transport rollers 37*a* and introduced into the main transport path 36 upstream of the registration rollers 36*d* and then again transported along the main transport path 36 towards the transfer roller 31*d*. In other words, this permits image formation on the reverse side of the recording paper.

The automatic original feed portion 4 will be explained next. The automatic original feed portion 4 is constituted by a so-called reversing automatic document feeder. The automatic original feed portion 4, which can be used as the moving sheet system, comprises an original tray 43, which serves as a document placement portion, a middle tray 44, an original discharge tray 45, which serves as a document discharge portion, and an original transport system 46, which transports originals between the trays 43, 44, and 45.

The original transport system 46 comprises a main transport path 47, which is used to transport originals placed onto the original tray 43 via the original reading portion 42 to the middle tray 44 or the original discharge tray 45, and a sub transport path 48, which is used for feeding originals from the middle tray 44 to the main transport path 47.

An original pickup roller 47*a* and separation roller 47*b* are located at the upstream end of the main transport path 47 (portion facing the discharge side of the original tray 43). Moreover, a stacking plate 47*c* is located downstream of the separation roller 47*b*. As the original pickup roller 47*a* rotates, one of the sheets of the original placed on the original tray 43 passes between the separation roller 47*b* and stacking plate 47*c* and is fed to the main transport path 47. PS rollers 47*e*, 47*e* are located downstream from the confluence of the main transport path 47 and sub transport path 48 (in FIG. 1, portion "B"). The PS rollers 47*e*, 47*e* feed originals to the original reading portion 42 by coordinating the image reading timing of the scanner portion 2 and the leading edge of the originals. In other words, after an original has been delivered, the PS rollers 47*e*, 47*e* pause the transport of the original to adjust the above-mentioned timing, and then feed the original to the original reading portion 42.

The original reading portion 42 comprises a glass platen 42*a* and an original pressing plate 42*b* and, when an original fed by the PS rollers 47*e*, 47*e* passes between the glass platen 42*a* and the original pressing plate 42*b*, the original is illuminated with light from the exposing light source 21 through the glass platen 42*a*. At such time, original image data acquisition is carried out by the scanner portion 2. An urging force is applied to the rear side (top face) of the original pressing plate 42*b* by a coil spring, not shown. As a result, the original pressing plate 42*b* comes into contact with the glass platen 42*a* and applies a predetermined pressure thereto, preventing the original from flying off the glass platen 42*a* as the original passes through the original reading portion 42.

Transport rollers 47*f* and original discharge rollers 47*g* are provided downstream of the glass platen 42*a*. After crossing the glass platen 42*a*, the original goes through the transport rollers 47*f* and the original discharge rollers 47*g* and is discharged into the middle tray 44 or the original discharge tray 45.

A middle tray swinging plate 44*a* is located between the original discharge rollers 47*g* and the middle tray 44. The edge of the middle tray swinging plate 44*a* that faces the middle tray 44 serves as the swing center, allowing the plate to swing between position 1 illustrated in FIG. 1 and position 2, which is reached when it is swung upwardly from position 1. When the middle tray swinging plate 44*a* is in position 2, originals discharged from the original discharge rollers 47*g* are retrieved onto the original discharge tray 45. On the other hand, when the middle tray swinging plate 44*a* is in position 1, originals discharged from the original discharge rollers 47*g* are discharged onto the middle tray 44. When an original is discharged onto the middle tray 44, the edge of the original is sandwiched between the original discharge rollers 47*g*, 47*g* and when the original discharge rollers 47*g* counter-rotate from this state, the original is fed to the sub transport path 48, passes along the sub transport path 48, and is again fed to the main transport path 47. The counter-rotation of the original discharge rollers 47*g* is carried out by coordinating the feeding of the original to the main transport path 47 and the timing of image reading. As a result, images on the reverse side of the original are read by the original reading portion 42.

<Outline of Paper Finishing Portion 5 and Discharge Tray 8>

The paper finishing portion 5 and the discharge tray 8 will be explained next.

The paper finishing portion 5 makes it possible to perform multiple paper finishing operations, such as punching, stapling, etc. on recording paper discharged from the main body of the apparatus upon completion of printing. As described below, such paper finishing operations are performed in the paper finishing portion 5 if a paper finishing request is present as a printing condition at the time of the print request.

In this embodiment, the paper finishing portion 5 and the discharge tray 8 are arranged not outside the main body of the multifunction machine 1, but inside a space C formed in the main body of the apparatus. Specifically, a paper cassette 33, an image forming portion 3 (image forming system 31), and a scanner portion 2 are disposed in the main body of the multifunction machine 1 in approximately the shape of a sideways U, with the paper finishing portion 5 and the discharge tray 8 provided inside the sideways U-shaped inner space C formed in the main body of the apparatus. This permits installation of the paper finishing portion 5 and the discharge tray 8 in the space defined inside the multifunction machine 1 and allows for multiple paper-finishing operations to be performed on recording paper. The footprint of the multifunction machine 1 provided with the paper finishing portion 5 is thus minimized, which helps achieve space savings. In addition, since the paper finishing portion 5 is provided with plural functions and is capable of plural paper finishing operations, the apparatus is rendered functionally superior to cases, in which the paper finishing portion provided is capable of carrying out only a single paper finishing operation, the number of user-selectable paper finishing operations is increased, improved convenience is achieved, and a wider range of users is attained. The paper finishing portion 5 and the discharge tray 8 are explained in detail below with reference to FIGS. 2 to 9. It should be noted that the direction, in which recording paper is transported (direction shown in FIG. 3), is called "paper transport direction", and the width direction of the recording paper (also shown in FIG. 3), which is transverse thereto, is called "paper width direction".

As shown in FIG. 2, the paper finishing portion 5 is disposed downstream of the discharge rollers 36*e* in the main body of the apparatus. As a paper finishing unit, the punching unit 60 equipped with a hole-punching capability, and a stapling unit 70 equipped with stapling functionality, are provided in the paper finishing portion 5. The front face of the paper finishing portion 5 (the surface of the proximal front side) is covered with an openable cover 50. In addition, in the paper finishing portion 5, the punching unit 60 is disposed upstream and the stapling unit 70 is disposed downstream. The discharge tray 8 is arranged downstream of the paper finishing portion 5. Recording paper discharged from the discharge rollers 36*e* passes through the punching unit 60 and stapling unit 70 and is discharged onto the discharge tray 8.

Thus, the punching unit 60 is disposed upstream and the stapling unit 70 is disposed downstream in the paper finishing portion 5 due to the fact that while hole-punching in recording paper in the punching unit 60 is carried out using one sheet at a time, stapling in the stapling unit is performed using multiple sheets at a time. It should be noted that a dummy unit equipped with recording paper transport capability only may be provided instead of the punching unit 60 or stapling unit 70. However, the discharge tray 8 may be disposed by fitting it in the space upstream without providing a dummy unit instead of the stapling unit 70. In this case, recording paper switchback, which is described below, is carried out by rollers (rollers disposed in a location adjacent the discharge tray 8) disposed in the farthest downstream section of the punching unit 60.

<Regarding Schematic Configuration of Punching Unit (Punching Apparatus) 60>

The punching unit 60 carries out hole-punching (punching) in recording paper discharged from the discharge rollers 36*e*. The punching unit 60 comprises a hole-punching mechanism 61, a guide plate 62, a punch waste collecting container 63, etc. In addition, a main transport path 51 is formed as part of the above-described paper transport system 32. Transport rollers 56 are arranged along the main transport path 51 in the punching unit 60. It should be noted that, unlike the hereinafter described stapling unit 70, the punching unit 60 is secured to the main body of the apparatus.

If a punching request is present as a printing condition at the time of the print request, recording paper that has been transported to the punching unit 60 is halted on the guide plate 62 in the punching unit 60 and hole-punching is carried out by the hole-punching mechanism 61 using one sheet at a time. At such time, punch holes are made in locations determined on the basis of the printed paper size.

The hole-punching mechanism 61 is disposed in the upper portion of the punching unit 60, and a hole-punching punch 64, whose diameter matches the diameter of the punch holes, is arranged in two locations at a predetermined spacing along the paper width direction in the hole-punching mechanism 61. The hole-punching punch 64 is arranged to be movable up and down, with punch holes formed in the recording paper when the hole-punching punch 64 descends. Moreover, the hole-punching punch 64 is arranged to be reciprocatingly movable in the paper transport direction and paper width direction so as to enable positional alignment during punching, as described below.

The guide plate 62 is disposed under the hole-punching mechanism 61 and an opening corresponding to a predetermined location used for making punch holes is formed in the guide plate 62. The punch waste collecting container 63 is situated under the punching unit 60, with the punch waste generated by hole-punching collected in the punch waste collecting container 63. The punch waste collecting container 63 is arranged to be slidable in the paper width direction so as to permit removal from the proximal front side when the cover 50 is opened, as described below. As a result, punch waste collected in the punch waste collecting container 63 can be removed.

When punching is performed in the punching unit 60, the hole-punching punch 64 of the hole-punching mechanism 61 travels locations corresponding to the above-mentioned positions determined on the basis of the printed paper size.

In addition, the fine positional adjustment of the hole-punching punch 64 of the hole-punching mechanism 61 of the punching unit 60 is carried out such that punching holes can be formed in the exact locations mentioned above determined on the basis of the printed paper size. Such fine positional adjustment is carried out by moving the hole-punching punch 64 of the hole-punching mechanism 61*a* certain distance forward, backward, right, and left, and is performed in registration with locations traversed by recording paper transported to the punching unit 60. Specifically, a line sensor 36*f*, which detects the side edges of recording paper that has passed through the fixing unit 39 while detecting its leading and trailing edges, is arranged upstream of the discharge rollers 36*e*. After detecting the position of the recording paper transported to the punching unit 60 in the paper transport direction with the help of the line sensor 36*f*, the hole-punching punch 64 is moved a certain distance in the paper transport direction. In addition, after detecting the position of the recording paper transported to the punching unit 60 in the paper width direction using the line sensor 36*f*, the hole-punching punch 64 is moved a certain distance in the paper width direction.

As described above, in the multifunction machine 1, recording paper is transported using the central reference system, which facilitates positional alignment of the hole-punching punch 64 of the above-mentioned hole-punching mechanism 61. In particular, normally, there are two punch hole locations symmetrical about the center in the width direction of the recording paper. A high degree of precision is required of the punch hole locations in the width direction of the recording paper. Therefore, a high degree of precision is also required in terms of travel precision of the hole-punching punch 64 of the hole-punching mechanism 61. Accordingly, in this embodiment, transporting the recording paper in accordance with the central reference system permits detection of shifting relative to a central reference point in the width direction of the transported recording paper and allows for moving the hole-punching punch 64 of the hole-punching mechanism 61 in accordance with the shift. This makes it possible to increase the precision of positioning of punch holes formed in recording paper. In addition, such positional alignment can be carried out in a similar manner for all sizes of transported recording paper.

<Regarding Stapling Unit 70>

The stapling unit 70 staples recording paper transported from the punching unit 60 located upstream. The stapling unit 70, as described below, is arranged to be slidable in the paper transport direction when the cover 50 is opened. In addition, as described below, the stapling unit 70 is arranged to be releasably engageable with the punching unit 60 disposed upstream of the stapling unit 70.

A stapling mechanism 71, a stapling stage 72, alignment plates 73, discharge rollers 74, etc. are provided in the stapling unit 70. In addition, the main transport path 51 and the switchback transport path 52 are formed as part of the above-described paper transport system 32. The branch catch 53 used for switching the direction, in which recording paper is guided, and discharge rollers 54, which discharge recording paper onto the stapling stage 72, are arranged at the connecting point between the downstream side of the main transport path 51 and upstream side of the switchback transport path 52. In addition, switchback rollers 55 are arranged on the downstream side of the switchback transport path 52.

If a stapling request is present as a printing condition at the time of the print request, a predetermined number of sheets of recording paper stacked on the stapling stage 72 are stapled by the stapling mechanism 71 in the stapling unit 70. At such time, stapling is carried out in locations determined on the basis of the printed paper size and desired stapling locations. The term "desired stapling locations" refers to locations where a user would like stapling to be performed, e.g. it may be a single location in the upper left corner of the recording paper, or two locations along the left edge, etc.

The stapling mechanism 71, which is disposed under the discharge rollers 54, uses a stapling needle to staple the trailing edges of recording paper sheets stacked on the stapling stage 72. The stapling mechanism 71 is adapted to be reciprocatingly movable in the paper width direction, thereby allowing stapling to be performed in positions determined on the basis of the above-mentioned printed paper size and desired stapling locations. When stapling is performed by the stapling unit 70, the stapling mechanism 71 is moved to positions corresponding to positions determined on the basis of the above-mentioned printed paper size and desired stapling locations.

The stapling stage 72, on which recording paper discharged from the discharge rollers 54 is stacked, serves as a stapling stage for the stapling mechanism 71. The stapling stage 72 is disposed such that its downstream side in the paper transport direction is upwardly inclined. When stapling is performed, recording paper discharged from the discharge rollers 54 slides under its own gravity down the incline of the stapling stage 72 towards the upstream side in the paper transport direction. On the other hand, when stapling is not performed, the recording paper, as described below, is discharged from the discharge rollers 74 onto the discharge tray 8.

The alignment plates 73 are disposed facing both sides of the top face (the surface, onto which recording paper is discharged) of the stapling stage 72 in the paper width direction. A pair of alignment plates 73 are arranged to be reciprocatingly movable in the paper width direction. When stapling is performed in the stapling unit 70, sheet-to-sheet alignment of recording paper discharged onto the stapling stage 72 in the paper width direction is carried out by moving the alignment plates 73 in the paper width direction. At such time, the alignment plates 73 are moved in accordance with the range of movement in the width direction determined on the basis of the transported printed paper size, that is, the size of the transported recording paper.

The reciprocation of the pair of alignment plates 73 can be implemented, for instance, using a rack-and-pinion mechanism. Specifically, a rack member connected to one of the alignment plates 73 and a rack member connected to the other alignment plate 73 are arranged at a predetermined spacing. In addition, a pinion gear is disposed between the two rack members and is meshed with both rack members. Although both rack members herein are arranged to be reciprocatingly movable in the paper width direction, the pinion is arranged to be restrained against movement. Additionally, a pair of alignment plates 73 travel in the paper width direction in a mutually symmetrical way when the pinion gear is rotated by transferring power from a drive source. This makes it possible to align recording paper discharged onto the stapling stage 72 in the paper width direction.

<Regarding Discharge Rollers 74>

The discharge rollers 74 are a pair of top and bottom rollers that are disposed adjacent the discharge tray 8 in the farthest downstream portion of the stapling stage 72 in the paper transport direction and that discharge recording paper on the stapling stage 72 onto the discharge tray 8. The discharge rollers 74 are also used as shifter rollers that discharge recording paper onto the discharge tray 8 while simultaneously sorting it, as described below. The top and bottom discharge rollers 74 are both drive rollers. In other words, the top and bottom discharge rollers 74 are both connected to a drive source.

In addition, the top and bottom discharge rollers 74 are arranged to be movable towards and away from each other, with one (in this case, the upper one) of the discharge rollers 74 arranged to be movable in the vertical direction relative to the other (in this case, the lower one) discharge roller 74. When recording paper is discharged onto the discharge tray 8, the top and bottom discharge rollers 74 are brought together under pressure, and, on the other hand, when recording paper is stapled, the top and bottom discharge rollers 74 are moved away from each other. It should be noted that the home position of the top and bottom discharge rollers 74 is the position of mutual contact.

The following advantages are obtained by arranging the top and bottom discharge rollers 74 to be movable towards and away from each other. When stapling is performed, the top and bottom discharge rollers 74 are moved away from each other, thereby permitting the leading edge of the recording paper delivered to the stapling stage 72 to protrude between the top and bottom discharge rollers 74. As a result, the length of the stapling stage 72 in the paper transport direction can be shortened and the stapling unit 70 can be made more compact. Then, after stapling, the top and bottom discharge rollers 74 are brought together under pressure and discharge a stack of stapled recording paper onto the discharge tray 8. Consequently, there is no need to provide a separate mechanism for discharging stapled recording paper stacks into the discharge portion, e.g. a mechanism for pushing recording paper stacks out.

Here, explanations will be provided regarding the shifting operation of the discharge rollers 74. In this embodiment, the operation of shifting the recording paper performed by the discharge rollers 74 allows the recording paper to be sorted and discharged onto the discharge tray 8.

The shifting operation consists in sorting recording paper by shifting the discharge position of the recording paper on the discharge tray 8 in the paper width direction by discharging recording paper onto the discharge tray 8 from multiple positions along the paper width direction. Such a shifting operation is made possible, for instance, by arranging the top and bottom discharge rollers 74 to be reciprocatingly movable in the axial direction (in the paper width direction). Specifically, after gripping recording paper with the top and bottom discharge rollers 74, the top and bottom discharge rollers 74 are moved in the axial direction. As a result, the recording paper gripped by the top and bottom discharge rollers 74 travels in the paper width direction. Then, when the recording paper is discharged onto the discharge tray 8 in that shifted position, the discharge position of the recording paper on the discharge tray 8 can be shifted in the paper width direction. Doing so permits sorting of recording paper units, such that the final page of a first unit is not discharged into the same position on the discharge tray 8 as the initial page of a second unit. In addition, using the discharge rollers 74 as shifter rollers permits reduction in the number of parts and a cost reduction. It should be noted that after discharging the recording paper, the top and bottom discharge rollers 74 are returned to their original position.

As described above, the following advantages are provided by arranging the top and bottom discharge rollers 74 to be movable towards and away from each other. In the past, when discharge rollers were also used as shifter rollers, the shifting operation was not performed during stapling. Namely, because the discharge rollers were not movable towards and away from each other, the shifting function of the discharge rollers was intended for handling only unstapled single sheets of recording paper and not for handling stapled stacks of recording paper. By contrast, in this embodiment, after stapling, stapled stacks of recording paper can be reliably gripped by bringing the top and bottom discharge rollers 74 together under pressure so as to carry out the shifting operation in this condition. This allows for the shifting operation to be carried out on stapled recording paper stacks in the same manner as in case of unstapled single sheets of recording paper.

<Regarding Sliding-Out of Stapling Unit 70>

The travel of the stapling unit 70 in the paper transport direction will be explained here as well. In this embodiment, the stapling unit 70 is adapted to reciprocate in the paper transport direction along with the hereinafter described discharge tray 8 and bottom 89 located under the discharge tray 8. It should be noted that the direction, in which the stapling unit 70 slides, may also be the paper width direction.

Slide rails 75 are arranged between the lower portion of the stapling unit 70 and an exterior 90 of the main body of the apparatus. Slide rails with ball bearings, for example, such as Accuride™, can be used for the slide rails 75. Specifically, the slide rails 75 are adapted to have holding members holding ball bearings intermediating the space between rails attached to the lower portion of the stapling unit 70 and rails attached to the exterior 90 of the main body of the apparatus. The smooth sliding of the stapling unit 70 relative to the main body of the apparatus is made possible by sliding the rails attached to the stapling unit 70 relative to the rails attached to the exterior 90 of the main body of the apparatus through the medium of the ball bearings.

Figure 7:
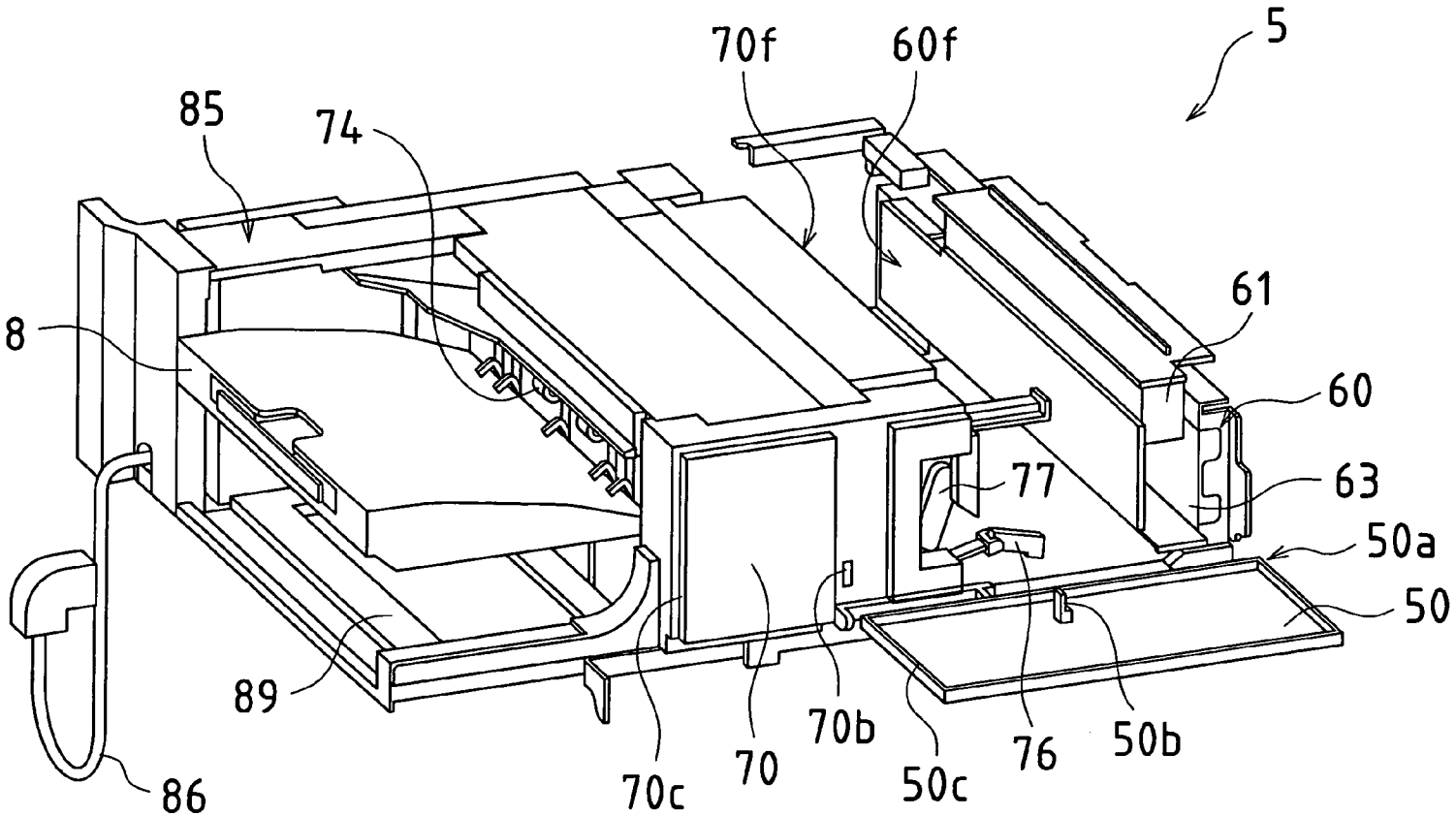
FIG. 7 is a perspective view showing the discharge tray and a stapling unit, with the stapling unit slid out.

Normally, the stapling unit 70 is disposed in contact with the punching unit 60 secured to the main body of the apparatus. On the other hand, when there is a jam in the main transport path 51 or switchback transport path 52, or when stapling needles are replaced or added, etc., the stapling unit 70 is slid out downstream in the paper transport direction. As shown in FIG. 7, the sliding movement forms a space between the stapling unit 70 and punching unit 60. This improves visibility and permits manual operations in this space. As a result, recording paper jammed in the main transport path 51 and switchback transport path 52 can be easily taken out and unjamming operations can be easily performed. Moreover, operations related to replacement and replenishment of stapling needles can also be easily carried out.

At such time, the maximum distance the stapling unit 70 can slide out downstream in the paper transport direction is the distance, at which the downstream edge of the stapling unit 70 in the paper transport direction will not protrude beyond the side face of the multifunction machine 1. In other words, the stapling unit 70 can be slid out to the extent that its downstream edge in the paper transport direction does not protrude beyond the main body of the apparatus. Limiting the slidable range of the stapling unit 70 in this manner protects the slide rails 75 from deformation etc.

Figure 8A:
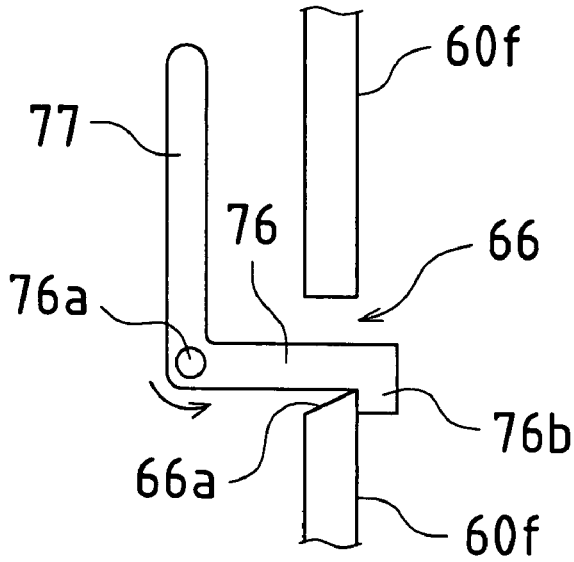
FIGS. 8(*a*) to 8(*c*) are explanatory views illustrating the engagement of a hook of the stapling unit with an engagement groove of a punching unit.
Figure 8B:
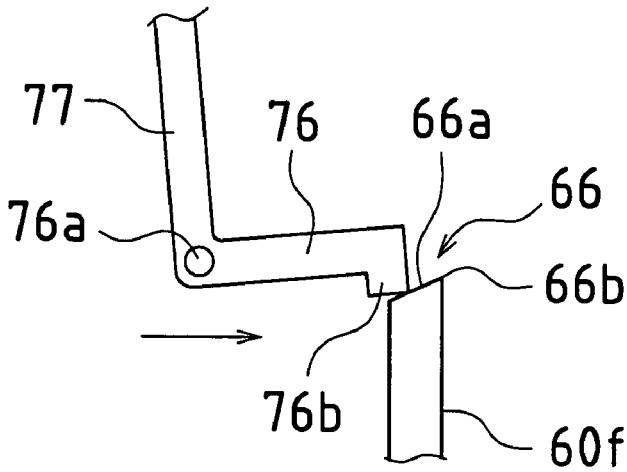

As described above, normally the stapling unit 70 is disposed in contact with the punching unit 60 secured to the main body of the apparatus. At such time, the stapling unit 70, as shown in FIG. 8(*a*), is secured to the punching unit 60 by the engagement of a hook 76 arranged in the stapling unit 70 with an engagement groove 66 arranged in the punching unit 60. The hook 76 is arranged to be rotatable about a rotary pivot 76*a*. In addition, the hook 76 is urged in the direction of clockwise rotation about the rotary pivot 76*a*. A distal end portion 76*b* of the hook 76 is substantially L-shaped for engagement with the engagement groove 66. The other end of the hook 76 is connected to a hook lever 77.

The stapling unit 70 is slid out downstream in the paper transport direction in the following manner. The engagement between the hook 76 and engagement groove 66 is broken by operating the hook lever 77 to rotate the hook 76 in the counterclockwise direction about the rotary pivot 76*a* against the urging force. This makes it possible for the stapling unit 70 to be moved downstream in the paper transport direction. Moving the stapling unit 70 downstream in the paper transport direction, as described above, facilitates jam removal operations, etc.

Figure 8C:
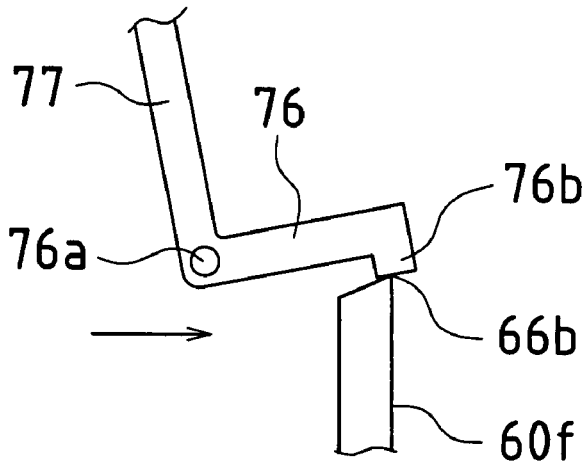

Conversely, upon completion of such a jam removal operation, etc., the stapling unit 70 is secured to the punching unit 60 in the following manner. When the stapling unit 70 is brought closer to the punching unit 60 by sliding it upstream in the paper transport direction, as shown in FIG. 8(*b*), the distal end portion 76*b* of the hook 76 abuts on an inclined surface 66*a* of the engagement groove 66. By sliding the stapling unit 70 further upstream in the paper transport direction in this state, the hook 76, as shown in FIG. 8C, is rotated in the counterclockwise direction about the rotary pivot 76*a* against the urging force. As the stapling unit 70 slides further upstream in the paper transport direction, the hook 76 overcomes an apex 66*b* of the engagement groove 66 and, as shown in FIG. 8(*a*), becomes engaged with the engagement groove 66. As a result, the stapling unit 70 is secured to the punching unit 60 and downstream travel of the stapling unit 70 in the paper transport direction is rendered impossible. It should be noted that an engagement groove may be provided in the stapling unit 70 and a hook may be provided in the punching unit 60.

<Regarding Cover 50>

Figure 3:
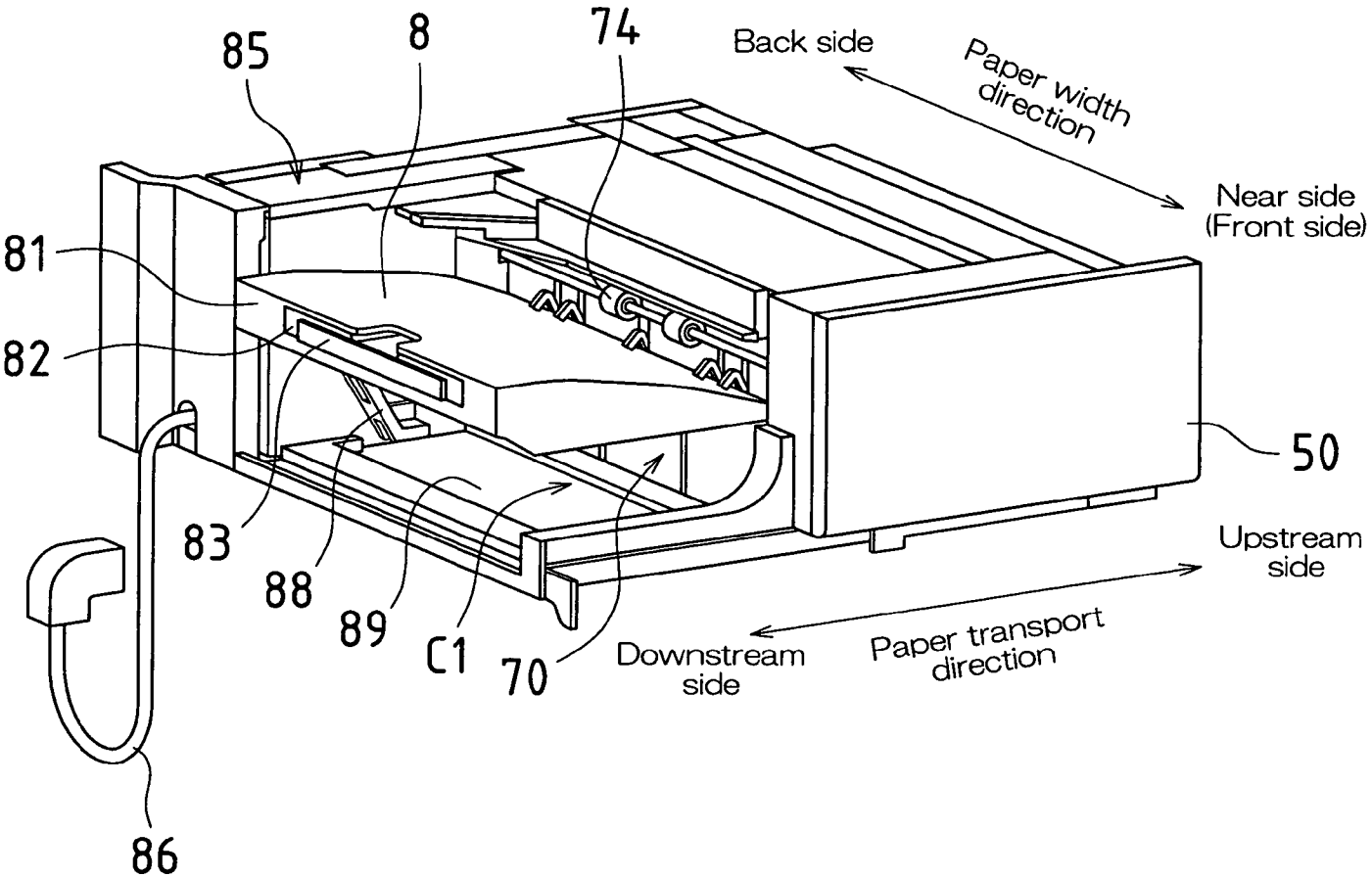
FIG. 3 is a perspective view showing the paper finishing portion and discharge tray, with the discharge tray stowed away and raised, and the cover closed.
Figure 4:
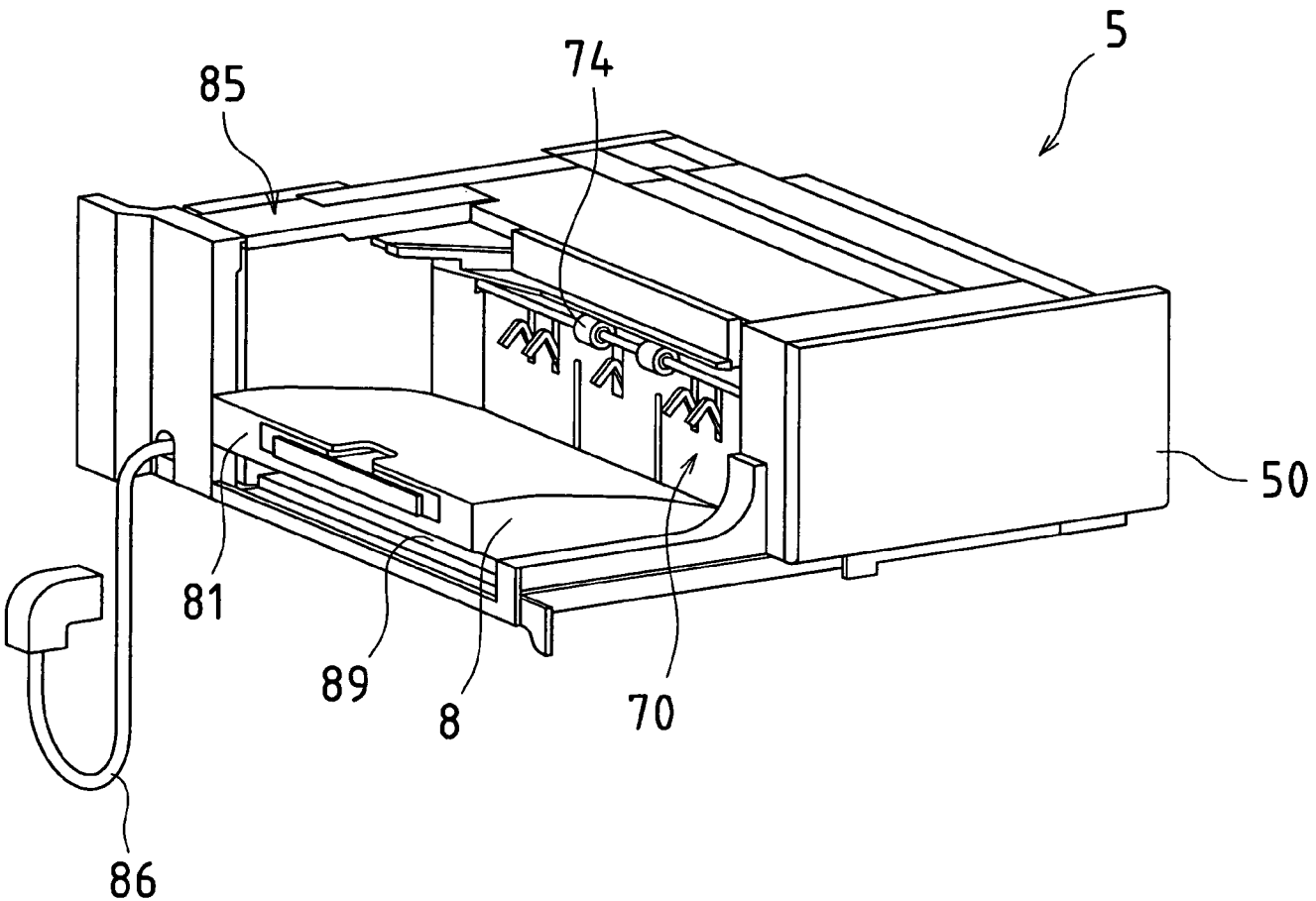
FIG. 4 is a perspective view showing the discharge tray in a lowered state.
Figure 5:
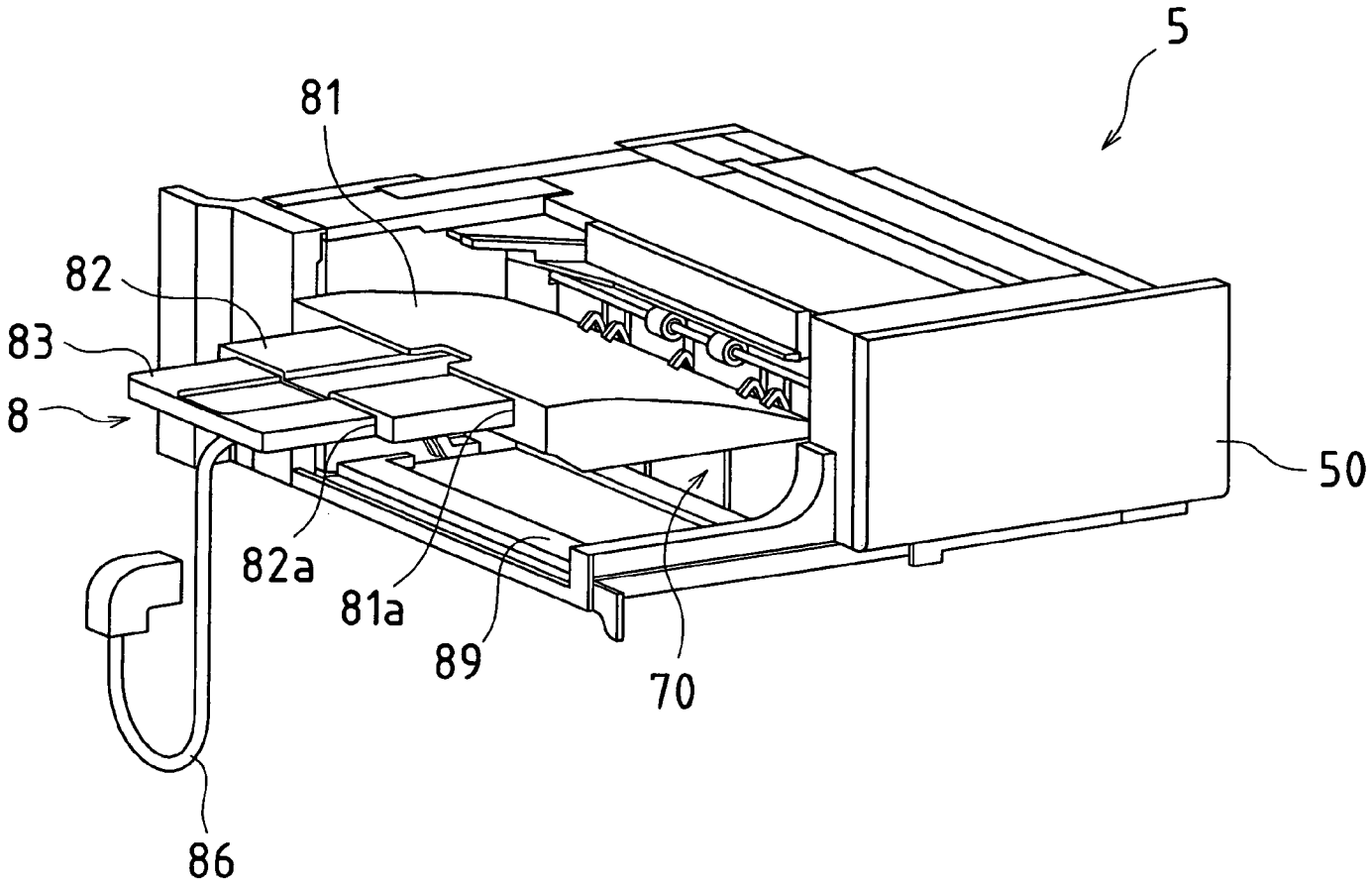
FIG. 5 is a perspective view showing the discharge tray in a deployed state.
Figure 6:
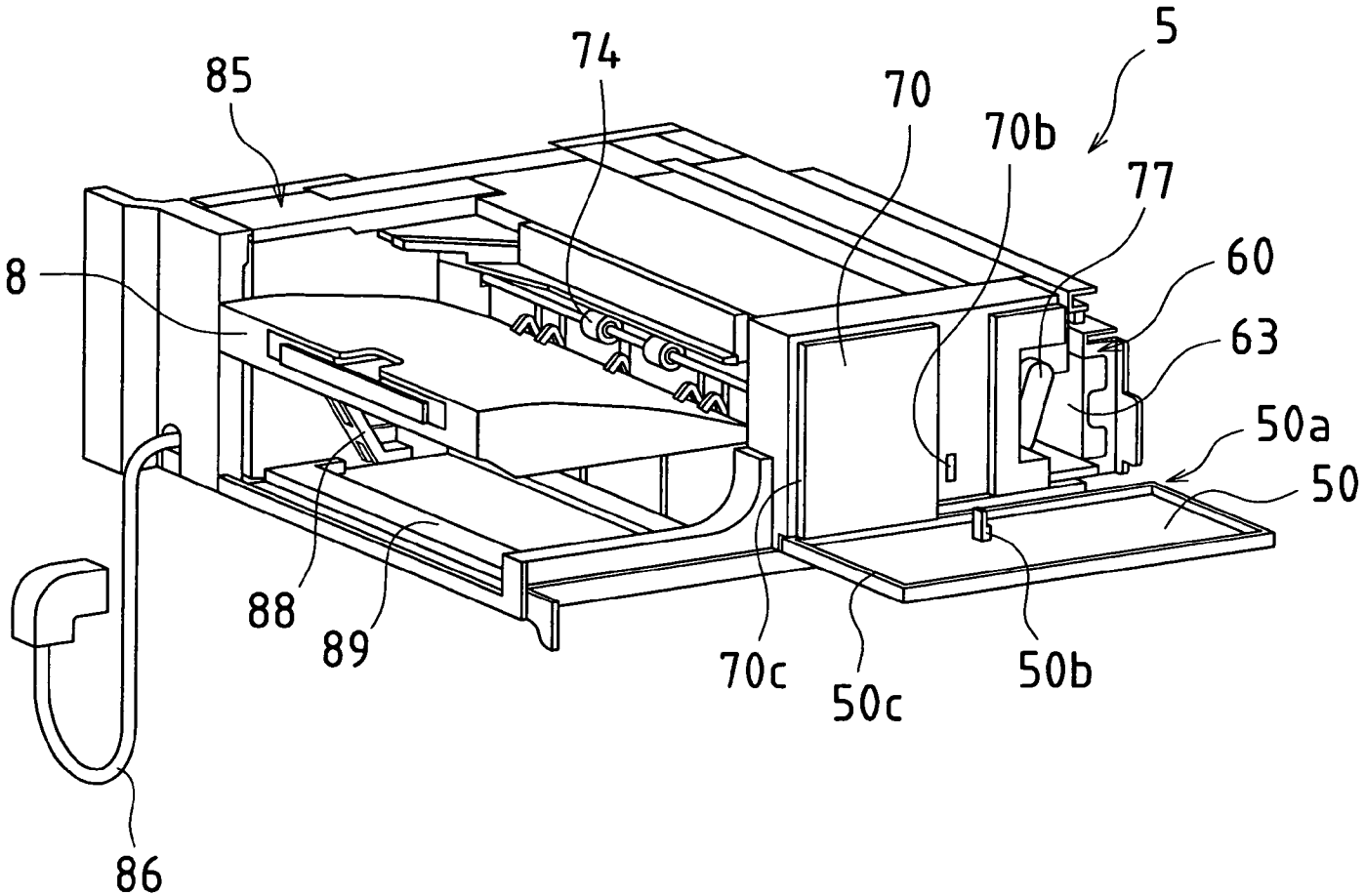
FIG. 6 is a perspective view showing a cover in an open state.

As described above, the cover 50 is arranged to be openable on the surface of the proximal front side of the paper finishing portion 5. The cover 50 is rotatable about a rotary axis 50*a* arranged at its lower end. As shown in FIGS. 3 to 5, when closed, the cover 50 is disposed vertically and covers the proximal front side of the paper finishing portion 5. Conversely, as shown in FIGS. 6 and 7, when open, the cover 50 is disposed substantially horizontally and reveals the proximal front side of the paper finishing portion 5. In this manner, when the cover 50 is open, the punch waste collecting container 63 can be removed to the proximal front side to dispose the punch waste in the punch waste collecting container 63.

The cover 50 is formed so as to be rectangular in front view and to have a size allowing for the entire surface of the proximal front side of the stapling unit 70 and punching unit 60 to be covered. A projection 50*b* protruding towards the inside (toward the paper finishing portion 5) is formed on the cover 50 such that, when the cover 50 is closed, the projection 50*b* engages with an engagement opening 70*b* formed in the stapling unit 70, thereby securing the cover 50 to the paper finishing portion 5. In addition, a projection protruding towards the inside is formed along the outer edge of the cover 50 and, when the cover 50 is closed, the projection of the cover 50 abuts on the edges of the surface of the proximal front side of the stapling unit 70 and punching unit 60. A projection 50*c* formed on the edge facing the stapling unit 70 is arranged to serve as a limiting projection for limiting the position of the stapling unit 70.

Figure 9:
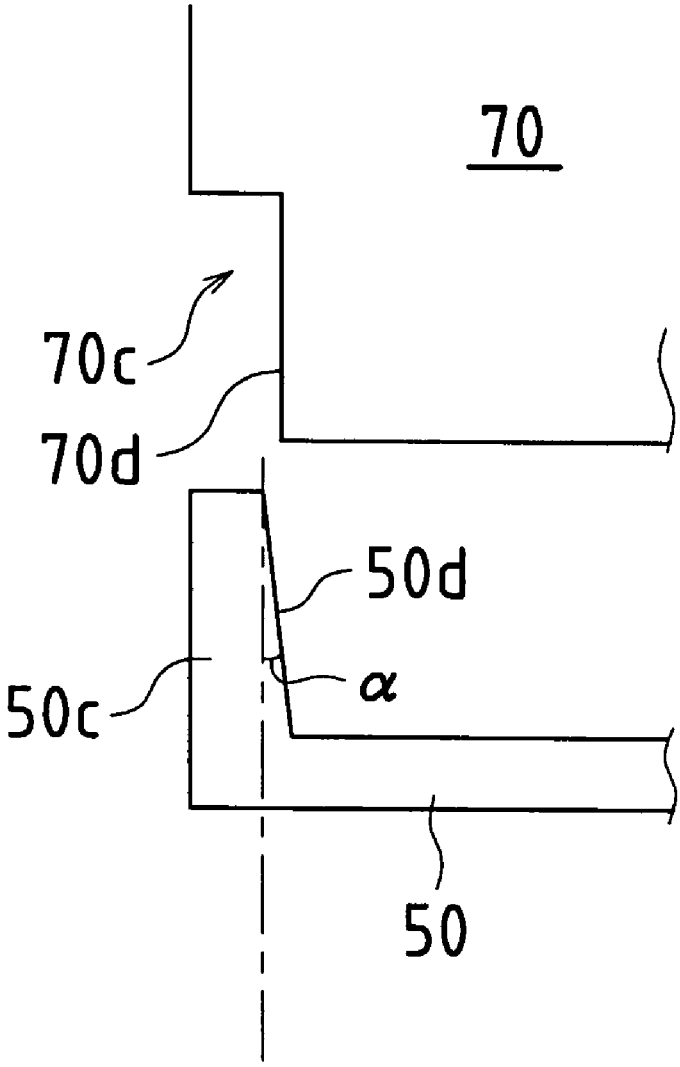
FIG. 9 is an explanatory view illustrating the abutment of a limiting projection of the cover on a limiting groove portion of the stapling unit.

The limiting projection 50*c* abuts on a limiting groove 70*c* formed on the upstream edge of the surface of the proximal front side of the stapling unit 70 in the paper transport direction. As shown in FIG. 9, in plan view, an abutment face 50*d* of the limiting projection 50*c* abutting on the limiting groove 70*c* is not formed to be parallel to the paper width direction (the alternate long and short dash line in FIG. 9), but instead is formed to be inclined at an angle $\alpha$ relative to the paper width direction. In this manner, the width of the limiting projection 50*c* in the paper transport direction is caused to gradually decrease towards the distal end (towards the inside of the paper finishing portion 5). On the other hand, in plan view, an abutment face 70*d* in the limiting groove 70*c* of the stapling unit 70 is formed to be parallel to the paper width direction.

The following advantages are obtained by providing the above-described limiting projection 50*c* on the cover 50. As described above, the stapling unit 70 is arranged to be releasably engageable with the punching unit 60. The stapling unit 70 is secured to the punching unit 60 by engaging the hook 76 of the stapling unit 70 with the engagement groove 66 of the punching unit 60. At such time, the mutually interfacing surfaces 60*f*, 70*f* face each other. Incidentally, as the distal end portion 76*b* of the hook 76 overcomes the apex 66*b* of the engagement groove 66 to engage the hook 76 with the engagement groove 66, a gap is formed between the mutually interfacing surfaces 60*f*, 70*f*.

In this embodiment, the cover 50 is closed after securing the stapling unit 70 by engaging the hook 76 with the engagement groove 66 by sliding the stapling unit 70 upwards in the paper transport direction. In this case, when the cover 50 is rotated and closed, the limiting projection 50*c* of the cover 50 abuts on the limiting groove 70*c* of the stapling unit 70. Furthermore, when the cover 50 is closed, the location of abutment of the limiting projection 50*c* on the limiting groove 70*c* gradually travels along the incline of the abutment face 50*d* of the limiting projection 50*c* toward the proximal front side. As a result, the stapling unit 70 is pressed against the punching unit 60. When the above-described projection 50*b* is engaged with the engagement opening 70*b* and the cover 50 is completely closed, the interfacing surface 70*f* of the stapling unit 70 is brought to a position where there is substantially no gap between it and the interfacing surface 60*f* of the punching unit 60, with the stapling unit 70 secured in this state.

Thus, as a result of providing the limiting projection 50*c* abutting on the edge of the stapling unit 70 when the cover 50 is closed, the gap formed between the stapling unit 70 and punching unit 60 can be reduced to a minimum when the cover 50 is closed. This makes it possible to keep the stapling unit 70 in a fixed position and prevent the vibration of the stapling unit 70.

In addition, the cover 50 is arranged to play the role of a switch used for switching the operation of the multifunction machine 10N and OFF. The term "operation of the multifunction machine 1" refers to the operation of each part of the multifunction machine 1 during printing, paper finishing, etc., and when the cover 50 is closed, the operation of the multifunction machine 1 is turned ON and various operations such as printing, paper finishing, etc. are permitted and enabled. Conversely, when the cover 50 is open, the operation of the multifunction machine 1 is turned OFF and various operations such as printing, paper finishing, etc. are prohibited and disabled. In this manner, the operation of the multifunction machine 1 is switched ON/OFF depending the opening/closing of the cover 50. In addition, if the cover 50 is open at the time of the print request, the user is prompted to close the cover 50.

Providing such a cover 50 acting as an ON/OFF switch in the paper finishing portion 5 ensures that no printing, paper finishing etc. is performed when the cover 50 is open, such as during jam removal operations, stapling needle replacement or replenishment operations, and the like. This makes it possible to ensure the safety of the multifunction machine 1 equipped with the paper finishing portion 5.

It should be noted that a closure (door), which can be opened and closed, is provided in the multifunction machine 1 in addition to the cover 50. Consequently, the operation of the multifunction machine 1 may be turned ON when all the closures in the multifunction machine 1 are closed, including the cover 50, and the operation of the multifunction machine 1 may be turned OFF when any of the closures of the multifunction machine 1 are open, including the cover 50.

<Regarding Transport of Recording Paper in Paper Finishing Portion 5>

The transport of recording paper in the paper finishing portion 5 will be explained next. As described above, the main transport path 51 and the switchback transport path 52 are formed in the paper finishing portion 5.

The main transport path 51 is formed to extend from the discharge rollers **36*e* in the main body of the apparatus, through the punching unit 60, and to the discharge rollers 54 disposed midway through the stapling unit 70. Along the main transport path 51, printed recording paper discharged from the discharge rollers 36*e* of the main body of the apparatus is transported to the stapling stage 72 of the stapling unit 70 or to the switchback transport path 52. If a punching request is selected as a printing condition at the time of the print request, the recording paper transported to the main transport path 51 upon completion of duplex printing or simplex printing is halted on the guide plate 62. The hole-punching punch 64 of the hole-punching mechanism 61** then descends and forms punch holes in predetermined locations of the rear edge of the recording paper.

The switchback transport path 52 is formed in the upper portion of the stapling unit 70, extending from the discharge rollers 54 to the switchback rollers 55. When recording paper is transported from the discharge rollers 54 to the switchback rollers 55 along the switchback transport path 52, the rear edge of the recording paper is gripped by the switchback rollers 55 and the switchback rollers 55 are then counter-rotated in this state. As a result, the movement of the recording paper is reversed, and the recording paper is transported from the switchback rollers 55 to the discharge rollers 54.

The switchback transport path 52 is used when printing on both sides of recording paper. In other words, when duplex printing is carried out in the multifunction machine 1, recording paper that has been printed on the front side is directed from the main transport path 36 of the main body of the apparatus via the main transport path 51 to the switchback transport path 52 and its movement is reversed in the switchback transport path 52. The reversed recording paper is then transported from the switchback transport path 52 via the main transport path 51 to the main transport path 36 of the main body of the apparatus, whereupon it is further introduced into the reverse transport path 37, thereby allowing for printing to be carried out on the reverse side of the recording paper. Recording paper that has been printed on the reverse side passes through the discharge rollers **36*e* of the main body of the apparatus and through the main transport path 51 and is discharged onto the stapling stage 72 of the stapling unit 70**.

On the other hand, if no duplex printing is performed on the recording paper, i.e. if printing is performed only on one side of the recording paper, the recording paper that has been printed on the front side is discharged from the discharge rollers 54 onto the stapling stage 72 "as is", without being transported from the main transport path 51 to the switchback transport path 52.

Thus, providing the switchback transport path 52 in the stapling unit 70 to carry out the switchback of the recording paper in the switchback transport path shortens the transport distance of the recording paper in comparison with cases, in which such the switchback is carried out using rollers discharging recording paper onto the discharge tray 8. Consequently, the efficiency of printing of the multifunction machine 1 in case of duplex printing can be enhanced.

In addition, in this embodiment, no transport paths such as the main transport path 51 and switchback transport path 52 are formed between the discharge rollers 54 and stapling stage 72 and recording paper is discharged from the discharge rollers 54 in a loosened state. For this reason, when the recording paper is switched back while being gripped by the discharge rollers 54, there is a chance that creases may be formed in the recording paper. Accordingly, in this embodiment, the formation of creases etc. in the recording paper is prevented by providing the switchback transport path 52, without using the discharge rollers 54 to perform the switchback of the recording paper. It should be noted that the switchback transport path 52 is not formed in the punching unit 60 disposed upstream from the stapling unit 70 because, as described above, the hole-punching mechanism 61 is disposed in the upper portion of the punching unit 60.

The above-described transport of recording paper is made possible by the pivotable movement of the branch catch 53 located at the point of contact (the point of bifurcation into the main transport path 51 and switchback transport path 52) between the downstream side of the main transport path 51 and the upstream side of the switchback transport path 52. The branch catch 53 is arranged to be pivotable about a horizontal axis between a first position (position indicated by the solid line) illustrated in FIG. 2 and a second position (position indicated by the alternate long and two short dashes line) illustrated in FIG. 2, which is reached by the branch catch 53 pivoting in the clockwise direction to open the switchback transport path 52. When the branch catch 53 is in the first position, recording paper can be discharged onto the stapling stage 72, and when it is in the second position, recording paper can be transported to the switchback transport path 52. It should be noted that the first position is the home position of the branch catch 53.

If simplex printing is selected as a printing condition at the time of the print request, the branch catch 53 is in the first position and recording paper that has been printed on the front side is guided to the stapling stage 72. On the other hand, if duplex printing is selected as a printing condition at the time of the print request, then the branch catch 53 is switched from the first position to the second position after the leading edge of the recording paper that has been printed on the front side passes through the fixing unit 39. As a result, the recording paper that has been printed on the front side is guided to the switchback transport path 52. In addition, the branch catch 53 is switched from the second position to the first position after the leading edge of the recording paper that has been printed on the reverse side passes through the fixing unit 39. As a result, the recording paper that has been printed on the reverse side is guided to the stapling stage 72.

Furthermore, if stapling is selected as a printing condition at the time of the print request, the branch catch 53, which is in the first position, is deflected after the trailing edge of the recording paper moves away from the discharge rollers 54 as the recording paper is discharged onto the stapling stage 72. By repeating such deflection of the branch catch 53 several times, the trailing edge of the recording paper leaving the discharge rollers 54 and falling onto the stapling stage 72 is pushed downward. As a result, the recording paper quickly reaches the stapling stage 72.

As described above, when stapling is performed, recording paper discharged onto the stapling stage 72 slides under its own gravity down the incline of the stapling stage 72 towards the upstream side in the paper transport direction. At such time, when while a sheet of recording paper slides down, the next sheet of recording paper is discharged and both sheets of recording paper are superimposed, with one on top of the other, at which point the bottom sheet of the recording paper may stop sliding down. Accordingly, the next sheet of recording paper is not discharged onto the stapling stage 72 until the first sheet of recording paper slides down to the edge of the stapling stage 72. For this reason, the longer it takes for the recording paper sheet to slide down to the edge of the stapling stage 72, the worse the efficiency of printing of the multifunction machine 1. Therefore, in this embodiment, as a result of deflecting the branch catch 53 and striking the trailing edge of the recording paper sheet, the time it takes for the recording paper sheet to slide down to the edge of the stapling stage 72 is made as short as possible and the efficiency of printing of the multifunction machine 1 is enhanced.

The sheet of recording paper discharged onto the stapling stage 72 from the discharge rollers 54 abuts on the stapling stage 72 from the leading edge. As the sheet of recording paper is discharged from the discharge rollers 54, the leading edge of the sheet of recording paper reaches the discharge rollers 74 located in the farthest downstream portion of the stapling stage 72. The subsequent transport of the recording paper sheet varies depending on whether stapling is performed in the stapling unit 70.

If stapling is not performed, then, as a result of the top and bottom discharge rollers 74 being brought together under pressure, the sheet is fed by the discharge rollers 74 and discharged onto the discharge tray 8. At such time, if a shifting request is present as a printing condition at the time of the print request, the recording paper is discharged onto the discharge tray 8 after the above-described shifting operation performed by the discharge rollers 74.

By contrast, if stapling is performed, the top and bottom discharge rollers 74 are away from each other. For this reason, the recording paper is not fed by the discharge rollers 74 even though the leading edge of the recording paper is fed between the top and bottom discharge rollers 74 by the discharge rollers 54. Accordingly, when the trailing edge of the recording paper leaves the discharge rollers 54 and the sheet loses its downstream conveying momentum in the paper transport direction, it slides down the incline of the stapling stage 72, to the upstream side in the paper transport direction, under its own gravity. This results in the alignment of the recording paper sheets in the paper transport direction.

Then, after a predetermined number of recording paper sheets have been discharged from the discharge rollers 54, aligned with, and stacked on the stapling stage 72, the trailing edges of the recording paper are stapled in the stapling mechanism 71. During the stapling procedure, the intermediate section of the recording paper is positioned between the top and bottom discharge rollers 74, which are spaced apart. Upon completion of stapling, the top and bottom discharge rollers 74 are brought together under pressure and a recording paper stack is discharged onto the discharge tray 8 by driving the discharge rollers 74. At such time, if a shifting request is present as a printing condition at the time of the print request, the recording paper is discharged to the discharge tray 8 after the above-described shifting operation performed by the discharge rollers 74.

As described herein, the following advantages are obtained by using drive rollers for both top and bottom discharge rollers 74. In this embodiment stapled recording paper stacks are discharged by the discharge rollers 74, but if a drive roller is used only for one of the discharge rollers 74 and a follower roller is used for the other, then the greater the number of sheets in a recording paper stack, the more difficult it will be for the drive roller to transmit rotation to the follower roller. As a result, there is a chance of tearing the recording paper in the locations, where stapling is performed using stapling needles. By contrast, using drive rollers for both top and bottom discharge rollers 74 makes it possible to discharge recording paper onto the discharge tray 8 smoothly, without damaging it.

<Regarding Discharge Tray 8>

The discharge tray 8 will be explained next.

The discharge tray 8 is arranged together with the above-described paper finishing portion 5 in the sideways U-shaped inner space C formed in the main body of the multifunction machine 1. Recording paper that has been finish-processed, i.e. punched, stapled, etc. in the paper finishing portion 5, is discharged onto the discharge tray 8. The discharge tray 8 is arranged to be telescopingly extensible in the paper transport direction (recording paper discharge direction). In addition, it is arranged to be movable in the vertical direction. Furthermore, it is arranged to be slidable relative to the main body of the apparatus.

As shown in FIGS. 3 and 5, the discharge tray 8 is formed as a tray that is telescopingly extensible into 1 and 3 sections in the paper transport direction. In this embodiment, the discharge tray 8 is adapted to permit manual telescoping by the user in the paper transport direction depending on the printed paper size.

The discharge tray 8 comprises a first discharge tray 81, a second discharge tray 82, and a third discharge tray 83. The first discharge tray 81 is the largest tray disposed in closest proximity to the paper finishing portion 5. The length of the first discharge tray 81 is such that it does not protrude beyond the side face (side wall) of the multifunction machine 1. The first discharge tray 81 is arranged to be restrained against movement in the paper transport direction.

The second discharge tray 82 is a mid-size tray contained within a receptacle portion 81*a* formed in the first discharge tray 81. The second discharge tray 82 is arranged to be movable in and out in the paper transport direction. The third discharge tray 83 is the smallest tray contained within a receptacle portion 82*a* formed in the second discharge tray 82. The third discharge tray 83 is arranged to be movable in and out in the paper transport direction.

When the discharge tray 8 is folded to form a single section only, as shown in FIG. 3, the length of the discharge tray 8 in the paper transport direction is shortest, with the third discharge tray 83 completely contained within the second discharge tray 82 and the second discharge tray 82 completely contained within the first discharge tray 81. At such time, the length of the discharge tray 8 in the paper transport direction is equal to the length of the first discharge tray 81 in the paper transport direction and is such that the tray does not protrude beyond the side face of the multifunction machine 1. In this manner, by preventing the discharge tray 8 from protruding beyond the main body of the apparatus in its most retracted state, the discharge tray 8 can be contained within the space of the main body of the apparatus when the multifunction machine 1 is not in use.

By contrast, when the discharge tray 8 is extended to form three sections, as shown in FIG. 5, the length of the discharge tray 8 in the paper transport direction is longest, with the second discharge tray 82 protruding from the first discharge tray 81 to a maximal degree and the third discharge tray 83 also protruding from the second discharge tray 82 to a maximal degree. At such time the length of the discharge tray 8 in the paper transport direction is longer than the length of the largest size of recording paper printable by the multifunction machine 1 in the paper transport direction. As a result, when the discharge tray 8 is extended to its maximum length, recording paper of even the largest printable size can be stacked thereon in a stable manner. As described below, the discharge tray 8 can be slid out together with the stapling unit 70, but no recording paper falls off the discharge tray 8 even if the discharge tray 8 is slid out with recording paper stacked on top of it.

As described above, the discharge tray 8 is arranged to be telescopingly extensible in the paper transport direction, which permits the discharge tray 8 to be used by adjusting its length to the optimum length depending on the printed paper size.

In addition, as shown in FIGS. 3 and 4, the discharge tray 8 is formed as a tray that can be raised and lowered in the vertical direction. In this embodiment, the discharge tray 8 is adapted to be raised and lowered depending on the amount (number of sheets) of the stacked recording paper.

The amount of recording paper discharged onto the discharge tray 8 is detected by an upper limit sensor 84 arranged in the vicinity of the bottom discharge roller 74. A contact-type sensor is used for the upper limit sensor 84. Then, when the uppermost surface of the recording paper stacked on the discharge tray 8 reaches a predetermined height, the upper limit sensor 84 is turned ON. As a result, it is detected that the discharge tray 8 is full. Then, in response to the detection of fullness, the discharge tray 8 descends a predetermined distance. The descent of the discharge tray 8 turns the upper limit sensor 84 OFF. The amount of recording paper stacked on the discharge tray 8 is detected as a result of the upper limit sensor 84 being switched ON/OFF in this manner. In this embodiment, the home position of the discharge tray 8 is the uppermost position of the discharge tray 8 (position illustrated in FIG. 3), with the edge of the discharge tray 8 on the upstream side disposed directly underneath the discharge rollers 74. Then, as the amount of stacked recording paper grows, the discharge tray 8 is gradually lowered. It should be noted that an optical sensor may be used as the upper limit sensor 84.

The discharge tray 8 is arranged to be telescopingly extensible, as described above, and, as the first discharge tray 81 is raised and lowered in the process of its vertical travel, the second discharge tray 82 and third discharge tray 83 are raised and lowered together with the first discharge tray 81.

The raising and lowering of the first discharge tray 81 is carried out in the following manner, for example. A driving portion 85 used for moving the first discharge tray 81 up and down is provided behind the first discharge tray 81. The driving portion 85 contains a driving belt (not shown), with the driving belt driven by a driving power source, not shown, which is connected to electrical wiring 86. Support members supporting the front edge of the first discharge tray 81 are connected to the driving portion 85. The support members are arranged to reciprocate in the vertical direction when driven by the driving belt. The driving power of the driving belt of the driving portion 85 is transmitted to the first discharge tray 81 via the support members, as a result of which the first discharge tray 81 moves up and down. In addition, an arm 88 supporting the first discharge tray 81 is provided underneath the first discharge tray 81. The arm 88 is disposed between the first discharge tray 81 and the bottom 89. In addition, the arm 88 is arranged in a curved L-like shape with a variable degree of curvature. The degree of curvature of the arm 88 varies depending on the vertical position of the first discharge tray 81. It should be noted that projections are provided along the edge of the first discharge tray 81 adjacent the paper finishing portion 5. The projections engage with vertically extending elongated grooves provided in the paper finishing portion 5 and can slide along the grooves.

The following advantages are attained by enabling the discharge tray 8 to be vertically raised and lowered and using its uppermost position as the home position. In case of a large vertical distance between the discharge tray 8 and discharge rollers 74 (the position, in which recording paper is discharged onto the discharge tray), stacking quality deteriorates because discharged recording paper practically falls onto the discharge tray 8. However, in this embodiment, lowering the discharge tray 8 from its uppermost position in accordance with the amount of stacked recording paper reduces the vertical distance between the discharge tray 8 and discharge rollers 74 to a minimum and maintains the excellent stacking quality of the recording paper discharged onto the discharge tray 8. In addition, the lowering of the discharge tray 8 makes it possible to ensure the amount of stacked recording paper to a certain degree, and to use the space within the main body of the apparatus in an efficient manner.

In addition, if the home position of the discharge tray 8 is set to a location below its uppermost position, from the standpoint of the above-mentioned stacking quality, it will be necessary to raise the discharge tray 8 to the uppermost position whenever the multifunction machine 1 is turned on, which may lead to an increase in the first copy output time and a decrease in the efficiency of printing. However, in this embodiment, the home position of the discharge tray 8 is set to its uppermost position, as a result of which there no need to raise the tray as described above, the first copy output time is not prolonged, and a decrease in the efficiency of printing is prevented.

As described above, the discharge tray 8 can be raised and lowered, and a space C1 is formed between the tray and bottom 89 located under the discharge tray 8. As shown in FIG. 3 and others, the inner side of space C1 is shielded by the above-described driving portion 85, etc., while the frontal and lateral sides of space C1 are left open. For this reason, various objects such as recording paper taken out of the discharge tray 8 upon completion of printing, a supply of recording paper to be added to the paper cassette 33, or replacement toner cartridges, etc. may be placed in this space C1. Incidentally, if the discharge tray 8 is lowered with such objects placed in this space, the discharge tray 8 or its driving portion 85 may be damaged and the objects placed in the space may be destroyed. Consequently, in this embodiment, the proximal and lateral sides of space C1 underneath the discharge tray 8 are covered with shielding members 91, 92. It should be noted that the shielding members 91, 92 are omitted in FIG. 1 and FIGS. 3 to 7.

The shielding member 91, which is arranged on the proximal front side of space C1, has its upper edge secured to the proximal portion of the first discharge tray 81 and its lower edge secured to the bottom 89. In addition, the shielding member 92, which is arranged on the lateral side of space C1, has its upper edge secured to the frontal portion of the first discharge tray 81 and its lower edge secured to the bottom 89.

In this embodiment the discharge tray 8 is arranged to be vertically movable, as a result of which the shielding members 91, 92 are arranged to telescope depending on the up-and-down travel of the discharge tray 8. Accordion curtain type members or shutter-type members for example are used for the telescoping shielding members 91, 92.

As a result of covering the space below the discharge tray 8 with the shielding members 91, 92, the space C1 formed underneath the discharge tray 8 is no longer open. As a result, placement of objects in the space C1 is prevented and, therefore, when the discharge tray 8 is lowered, the discharge tray 8 will not be damaged and no objects placed therein will be damaged.

In addition, as shown in FIG. 7 the discharge tray 8 can slide relative to the main body of the apparatus. In this embodiment, the discharge tray 8 is adapted for reciprocating travel in the paper transport direction together with the bottom 89 and stapling unit 70. It should be noted that the direction, in which the discharge tray 8 slides, may also be the paper width direction.

The bottom 89 underneath the discharge tray 8 is not secured to the main body of the apparatus and is connected to the stapling unit 70. Because the stapling unit 70, as described above, is arranged to be slidable relative to the main body of the apparatus, the bottom 89 is slidable together with the stapling unit 70. The bottom 89 is connected to the discharge tray 8 through the medium of the arm 88, shielding members 91, 92, etc., so that, when the bottom 89 slides, the discharge tray 8 slides along with it. It should be noted that slide rails are provided between the bottom 89 and exterior 90 of the main body of the apparatus.

<Configuration of Punching Unit (Punching Apparatus) 60 in Greater Detail>

The configuration of the punching unit (punching apparatus) 60 in the image forming apparatus of the above-described configuration, which constitutes the characteristic feature of the first embodiment, will be explained in greater detail below with reference to FIGS. 10 through 13.

Figure 10:
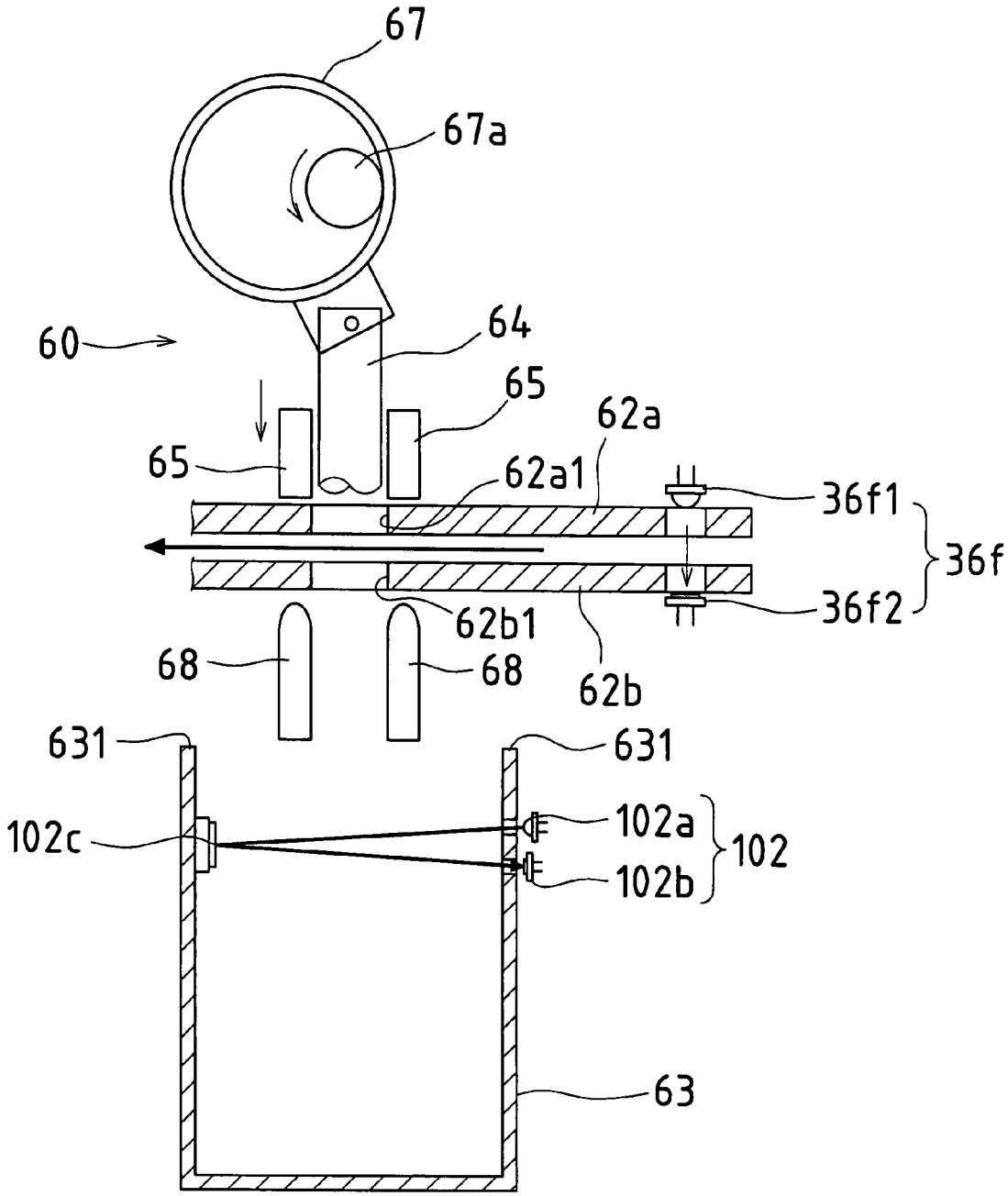
FIG. 10 is a partially enlarged schematic cross-sectional view illustrating a configuration of the punching unit in greater detail.
Figure 11A:
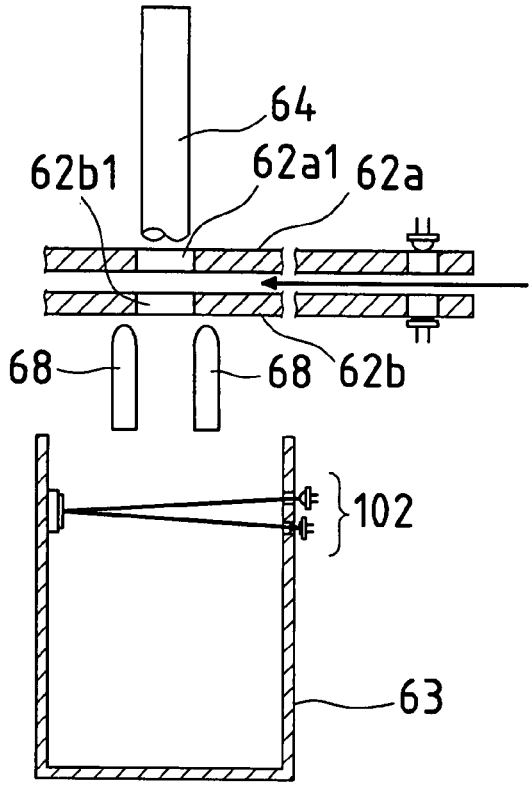
FIGS. 11 (*a*) to 11 (*d*) are explanatory views illustrating the punching operation of a hole-punching punch.
Figure 11B:
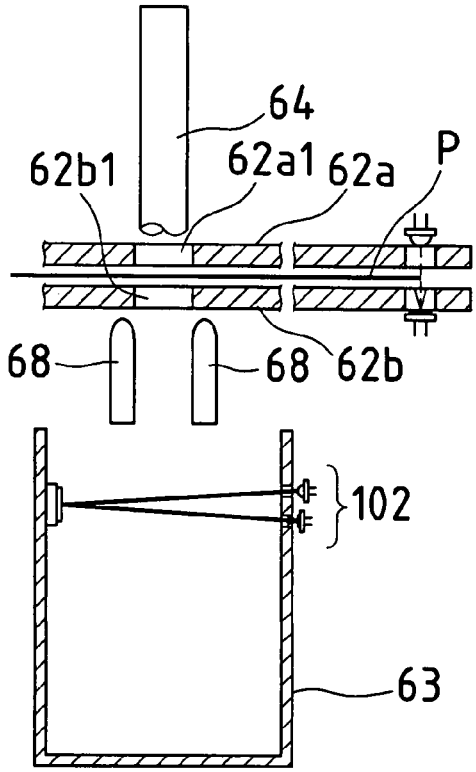
Figure 11C:
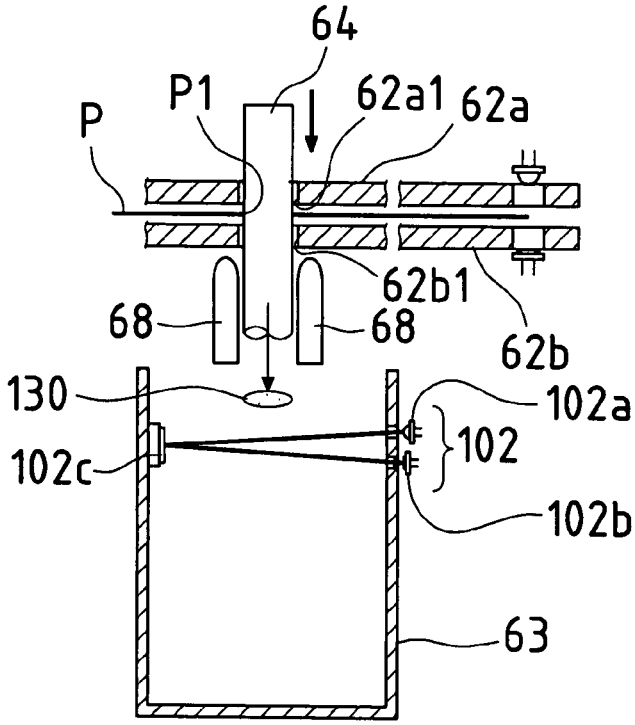
Figure 11D:
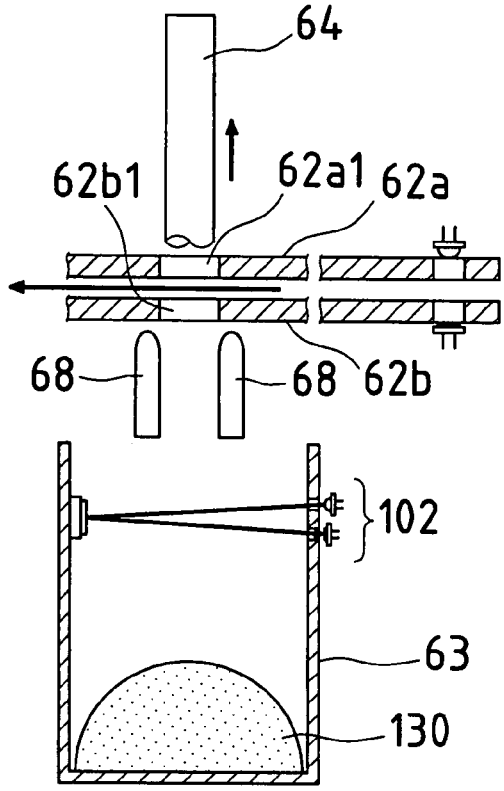

FIG. 10 is a partially enlarged schematic cross-sectional view illustrating a more detailed configuration of the punching unit 60.

In FIG. 10, the horizontal arrow indicates the direction of paper transport along a paper transport path formed by upper and lower paper guides 62*a*, 62*b*, that is, in FIG. 10, printed paper are transported in a right-to-left direction. After printing in the image forming portion, paper that have "punching" selected in the print request are discharged into the discharge portion via the paper transport path shown in FIG. 10 and, for paper that reach the punching unit 60 in the process of transport, their transport position in the paper width direction (direction normal to the surface of the paper), as well as the trailing edge of the paper, are detected using a line sensor (a light emitting element 36*f*1 and a light receiving element 36*f*2) 36*f*, which is disposed directly in front of the punching unit 60. Based on detecting the trailing edge of the transported paper in this manner, the timing used to halt the transported paper is calculated, the appropriate punching locations in the paper transport direction are determined, and the timing at which the transport of the paper is halted is determined.

Next, the detected values concerning position in the paper width direction are used to determine appropriate positions for the hole-punching dies 65 and hole-punching punch 64, which form part of the punching unit 60, whereupon the hole-punching dies 65 and hole-punching punch 64 are accordingly moved. This movement results in punching position alignment in the paper width direction and represents an important alignment similar to that in the paper transport direction. In other words, this alignment is essential in improving the stacking quality of punched paper during filing and enhances the appearance of paper stacks. It should be noted that the hole-punching dies 65 and hole-punching punch 64 used in the first embodiment are adapted to be switchable between two-hole and three-hole punching, which can be appropriately changed according to user choices.

In addition, the hole-punching punch 64 has its upper end connected to a rotary cam (eccentric cam) 67 and, as the punch shaft 67*a* is rotationally driven by the driving force of the driving source, not shown, the rotary cam 67 is rotated. In this case, punching is carried out when the hole-punching punch 64 performs a single vertical round trip as the punch shaft 67*a* rotates through 180 degrees from the home position (position illustrated in FIGS. 11(*a*) and 11(*b*)).

FIG. 11(*c*) illustrates a state, in which the punch shaft 67*a* has been rotated through 90 degrees from the home position, such that the hole-punching punch 64 has passed through a through-hole 62*a*1 formed in the upper paper guide 62*a* forming part of the paper transport path and a through-hole 62*b*1 formed in the lower paper guide 62*b* in a downward direction and has reached the lowermost position. In addition, FIG. 11(*d*) illustrates a state wherein the punch shaft 67*a* has been rotated through further 90 degrees from the state illustrated in FIG. 11(*c*) in the same direction, such that the hole-punching punch 64 has passed through the through-hole 62*b*1 formed in the lower paper guide 62*b* and the through-hole 62*a*1 formed in the upper paper guide 62*a* in an upward direction and has returned to the home position.

The punching operation between the state illustrated in FIG. 11(*b*) and state illustrated in FIG. 11(*d*) is carried out as a continuous operation. It should be noted that such punching operation is a previously known operation and will not be explained in greater detail herein.

Namely, as the punch shaft 67*a* is rotationally driven by the driving source and the rotary cam 67 is rotated through 180 degrees, the hole-punching punch 64 performs a single vertical round trip and a punch hole P1 is formed in a predetermined location of the paper P halted in an appropriate location relative to the punching unit 60 (as illustrated in FIG. 11(*b*)). The paper P, in which the punch hole P1 has been formed, is transported to the next process (discharge tray) by a control unit, not shown, which recognizes that a punch hole has been formed.

On the other hand, a chad 130 punched out of the punch hole falls between die assist guide plates 68 disposed underneath the lower paper guide 62*b* into the punch waste collecting container 63 disposed below. A fullness detecting sensor 102, which detects the amount of collected punch waste 130, is disposed in the punch waste collecting container 63 (hereinafter referred to as "collecting container"). The fullness detecting sensor 102 may be a mechanical sensor, but in the first embodiment, the sensor used is a reflective optical sensor. Namely, a reflector 102*c* is disposed in the upper portion of an inner wall of the collecting container 63, two openings are formed in the upper portion of another inner wall facing it, and a light-emitting element (light-emitting diode) 102*a* and a light-receiving element (photodiode) 102*b* are respectively disposed so as to face the two openings.

In the first embodiment, in the punching unit 60 of the above-mentioned configuration, a charge removal member 120 for punch waste is disposed in the collecting container 63.

Figure 12A:
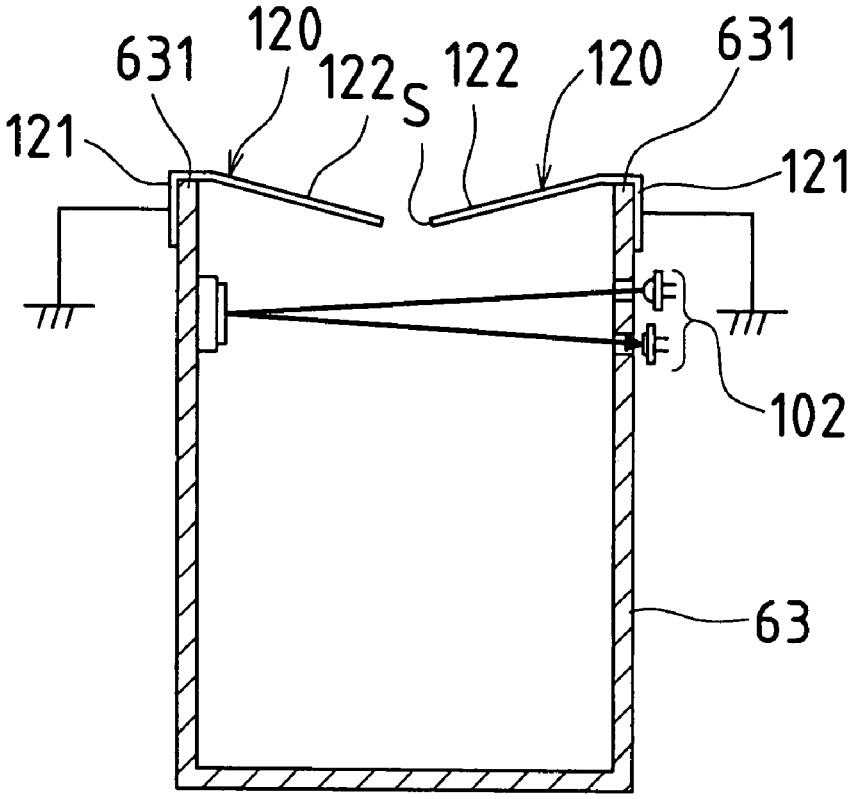
FIGS. 12(*a*) to 12(*c*) are explanatory views illustrating a configuration of a charge removal member in a first embodiment.
Figure 12B:
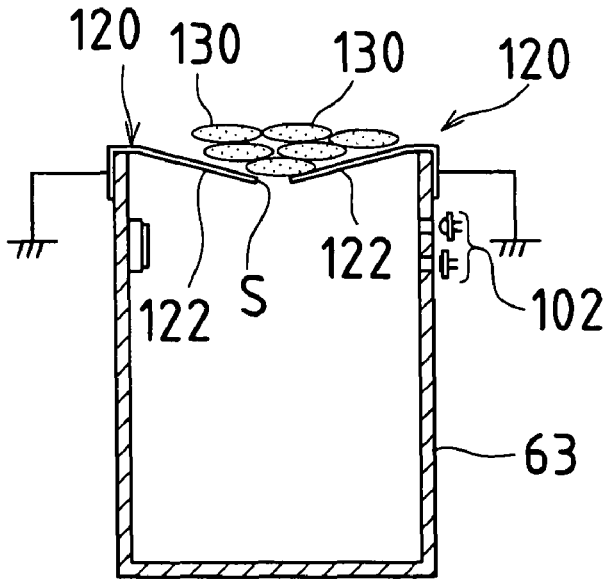
Figure 12C:
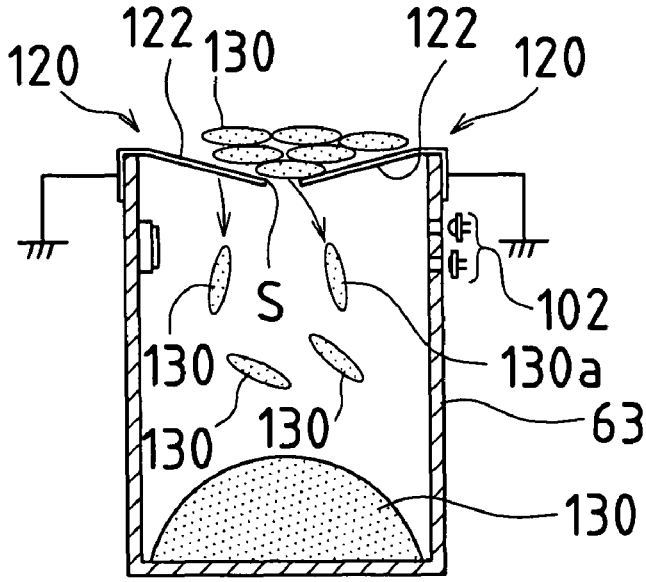
Figure 13:
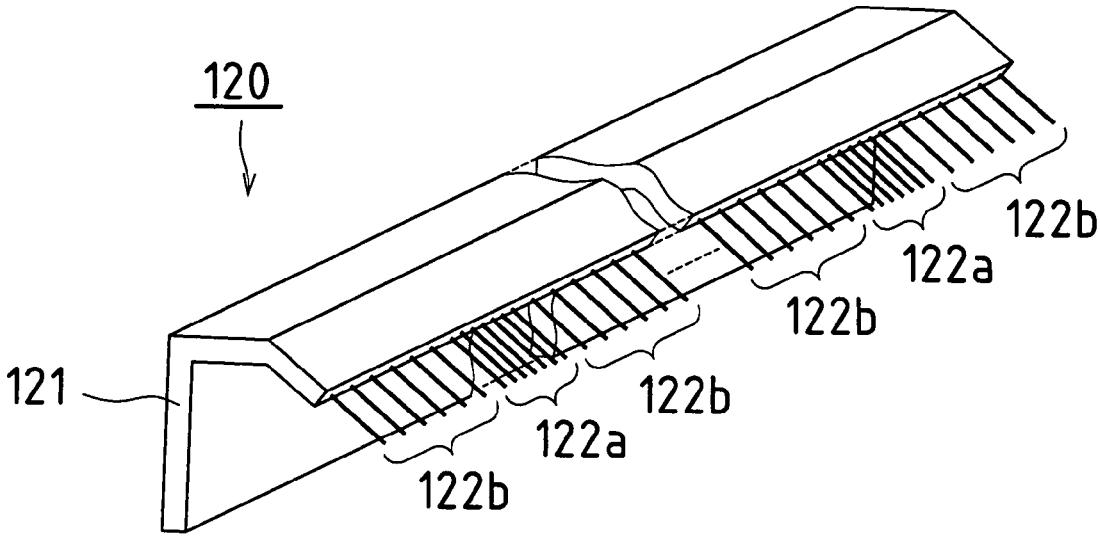
FIG. 13 is a perspective view illustrating the configuration of the charge removal member in the first embodiment.

FIGS. 12(*a*) to 12(*c*) and FIG. 13 illustrate the configuration of the charge removal member 120. Here, FIG. 13 illustrates the configuration of the charge removal member 120 when it is used for two holes.

The charge removal member 120 is formed from electrically conductive members, disposed respectively on the front and rear edges 631, 631 of the open top portion of the collecting container 63 in the paper transport direction. Namely, in the example illustrated in FIGS. 12(*a*) to 12(*c*) and FIG. 13, a paired right/left (front/rear) arrangement is used.

The charge removal member 120 has its proximal end portions 121 formed in a shape suited for abutting on the top face and peripheral side face of a top edge 631 of the collecting container 63, with the proximal end portions 121 secured to the collecting container 63. In addition, the proximal end portions 121 are grounded through the frame of the apparatus, not shown.

The distal end portions extending at a slight downward slant from the proximal end portions 121 into the vicinity of the central portion (into the vicinity of the central portion in the paper transport direction) of the collecting container 63 are formed as comb-shaped charge removal needles 122.

Here, a closure-like structure may be formed, in which the proximal end portions 121 are fitted around the entire periphery of the open top portion of the collecting container 63, that is, this may be a structure, in which they are detachably mounted in the open top portion of the collecting container 63. This is convenient when throwing away accumulated punch waste 130. In addition, in this case, in contrast to the proximal end portions 121 of the closure-like structure, only the charge removal needles 122 form a paired left/right (front/rear) structure.

The charge removal needles 122 are arranged at a spacing permitting entrapment of punch waste 130. In other words, they are disposed at a spacing permitting reliable capture (see FIG. 12(*b*)) of the punch waste 130 punched out of paper and allowing the waste to fall down between the charge removal needles 122 after charge removal (see FIG. 12(*c*)).

Furthermore, in the first embodiment, the charge removal needles 122 may be arranged so as to produce a high-density spacing state 122*a* in the portion corresponding to the hole-punching punch 64 (i.e. in the peripheral vicinity comprising the portion facing the hole-punching punch 64) and a low-density spacing state 122*b* in other portions. By arranging the needles using such low/high density spacing, electrostatically charged punch waste 130 is reliably captured in the high-density portion and prevented from being scattered from the collecting container 63, and, after destaticizing the punch waste 130 collected on the charge removal needles 122, the punch waste 130 is allowed to fall under its own gravity through the low-density portion 122*b*.

Here, the reason why the punch waste gathers around the charge removal needles 122 is because the punch waste 130 is caused to fall down naturally under its own gravity as a result of the shearing action of the hole-punching punch 64 and because the waste is attracted to the charge removal needles 122 by electrostatic forces built up on the punch waste 130.

The adhered punch waste 130 is gradually destaticized because the charge removal member 120 is grounded through the frame of the apparatus. The destaticized punch waste 130 falls down naturally when, as a result of the decrease in electrostatic forces, its electric field becomes weaker than the field required to attract it to the charge removal needles 122. In addition, it also falls down through the gaps between the charge removal needles 122 when the balance between the vibration of the apparatus resulting from the operation of the punching unit 60 and the electrostatic charge of the punch waste 130 is upset and vibration gains an upper hand over the electrostatic charge.

In addition, a predetermined space S is formed between the distal end portions of the opposed charge removal needles 122. This space S is formed to define a gap that allows waste to slide down a charge removal needle 122 on one side and fall into the collecting container 63 while avoiding interference from the distal ends of the charge removal needles 122 on the other side (see chad 130*a* in FIG. 12(*c*)). As a result, not only does the punch waste 130 fall down through the gaps between the charge removal needles 122, but it also falls down through the space S by sliding off the charge removal needles 122. Consequently, the phenomenon wherein punch waste 130 does not fall through the gaps between the charge removal needles 122 and unexpectedly accumulates on the charge removal needles 122 can be prevented in a more reliable manner.

Thus, the falling punch waste 130 does not possess the electrostatic forces of the punch waste 130 shown in Table 1, does not adhere to the surface of the walls of the collecting container 63, and accumulates in the bottom of the collecting container 63. As a result, the container fills appropriately, without blocking the fullness detecting sensor 102, and misdetection by the fullness detecting sensor 102 is eliminated.

It should be noted that, quite naturally, the position, in which the charge removal member 120 is disposed, is located above the fullness detecting sensor 102 and is not in contact with the lower end portion of the hole-punching punch 64 after a punching stroke and the die assist guide plates 68. In other words, as a result of disposing it above the fullness detecting sensor 102, the punch waste 130 accumulated inside the collecting container 63 no longer adheres to the fullness detecting sensor 102 and no longer interrupts the optical path used for detection. Moreover, disposing it in a location outside the range of vertical movement of the hole-punching punch 64 makes it possible to prevent the degradation of the charge removal needles 122 due to the contact of the distal end portion of the moving hole-punching punch 64 with the charge removal needles 122.

Second Embodiment

A second embodiment will be explained next. It should be noted that in this embodiment the same reference numerals are assigned to the same constituent elements as in the above-described first embodiment and explanations are provided with reference to FIGS. 14(*a*) through 16(*b*) mainly by focusing on its differences from the first embodiment.

In the second embodiment, in the punching unit 60, a charge removal member 160, which is constituted by an electrically conductive member removing static electricity built up on the punch waste 130 generated in the process of punching, is disposed within the range of movement of the hole-punching punch 64 in the punching unit 60.

Figure 14A:
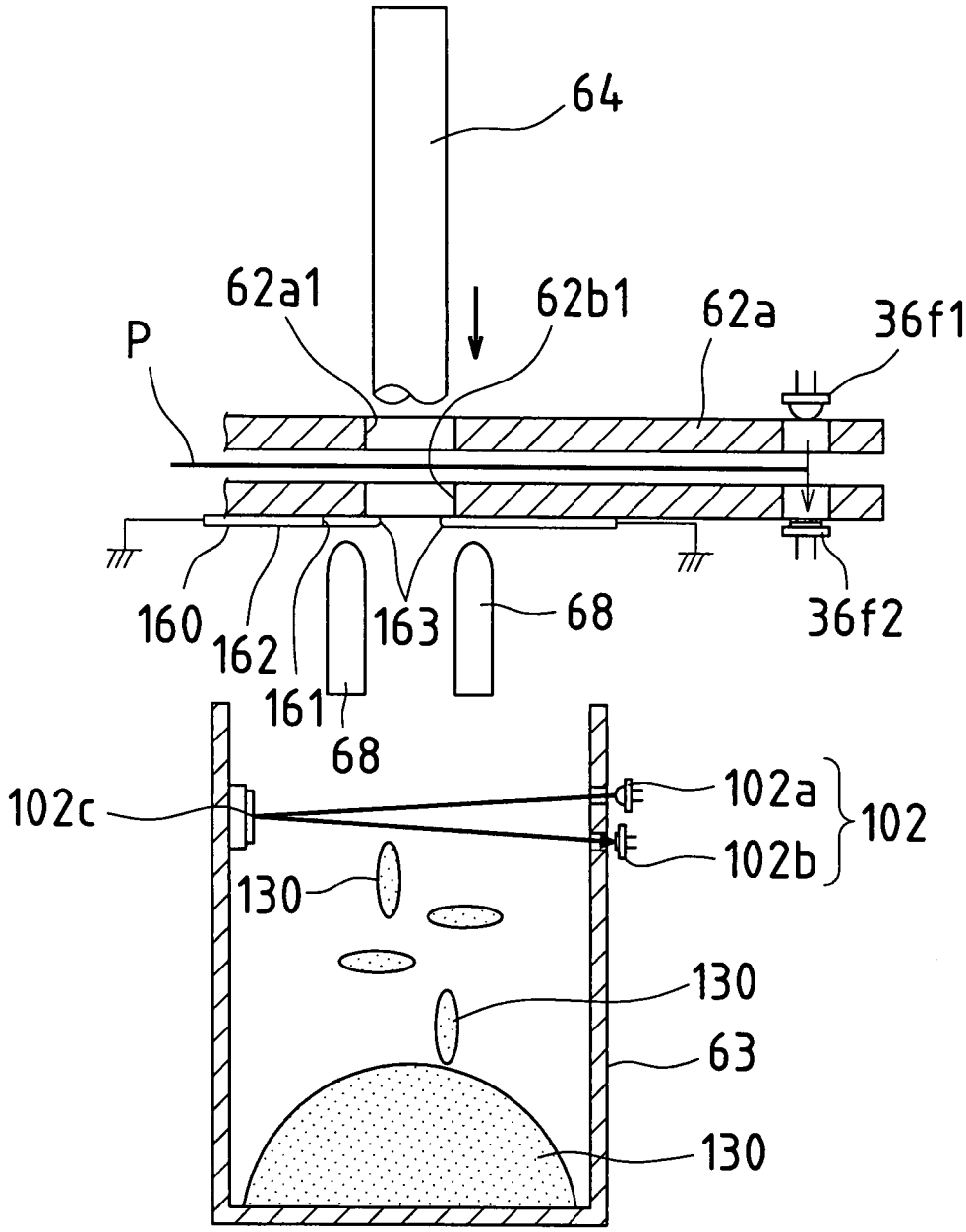
FIGS. 14(*a*) and 14(*b*) are explanatory views illustrating a configuration of the charge removal member in a second embodiment.
Figure 14B:
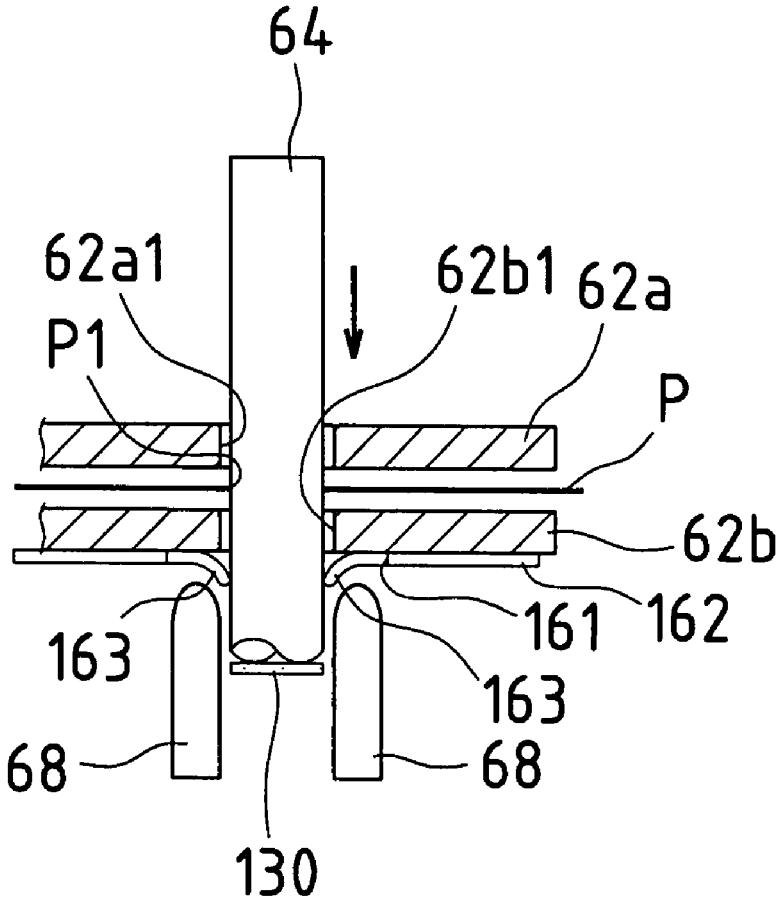
Figure 15:
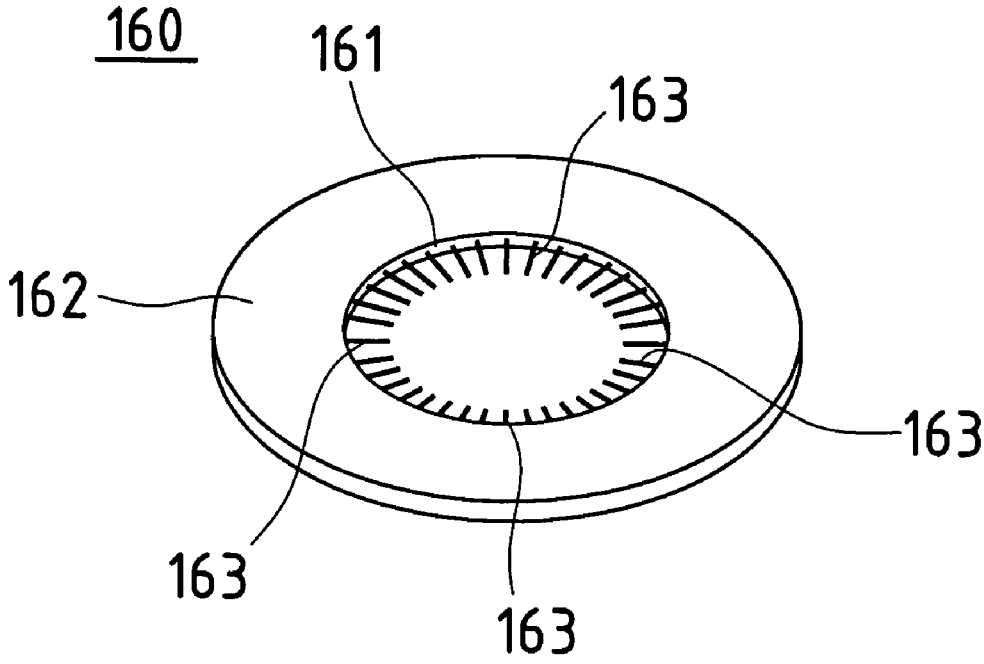
FIG. 15 is a perspective view illustrating the configuration of the charge removal member in the second embodiment.

FIG. 14(*a*), FIG. 14(*b*) and FIG. 15 illustrate the configuration of the charge removal member 160.

The charge removal members 160 comprises a ring-shaped main body portion 162 having a circular opening portion 161 in the center and multiple charge removal needles 163 extending from the main body portion 162 at a predetermined spacing to a predetermined length towards the center of the opening portion 161. The main body portion 162 of the charge removal member 160 is secured to the underside of the lower paper guide 62*b*, with the opening portion 161 aligned with the through-holes 62*a*1, 62*b*1 in the two paper guides 62*a*, 62*b*. In addition, the main body portion 162 is grounded through the frame of the apparatus, not shown.

As a result, during punching, the hole-punching punch 64 travels downwardly through the opening portion 161 while pushing down the punched-out punch waste 130 in such a manner that the distal end portions of the charge removal needles 163 are forced downwardly (see FIG. 14(*b*)) and, as a result, the charge removal needles 163 come into contact with punch waste 130 and hole-punching punch 64 (more precisely, the charge removal needles 163 come into contact with the side surfaces of punch waste 130 and hole-punching punch 64). In other words, when the hole-punching punch 64 descends, both the punch waste 130 punched out by the hole-punching punch 64 and the hole-punching punch 64 itself successively come into contact with the charge removal needles 163, thereby permitting removal of built-up static electricity not only from the punch waste 130, but also from the hole-punching punch 64 as well.

Accordingly, since the punch waste 130 punched out of paper P is reliably destaticized, the punch waste 130 can fall into the collecting container 63 naturally, without adhering to the die assist guide plates 68 or the surface of the walls of the collecting container 63 disposed thereunder. In addition, since the hole-punching punch itself is destaticized as well, when the hole-punching punch 64 travels upwardly through a punched hole P1 in the paper P after a punching stroke, the paper P does not get attracted to the hole-punching punch 64 under the action of static electricity. Accordingly, deformation etc. of the punch hole P1 in the paper P produced by the punch stroke of the hole-punching punch 64 can be prevented.

In addition, since the second embodiment is configured to provide the charge removal needles 163 of the charge removal members 160 in such a manner that they protrude into the range of movement of the hole-punching punch 64, the protrusion length of the charge removal needles 163 presents a problem.

Namely, if the length of protrusion is considerable, the distal ends of the charge removal needles 163 entrained by the distal end portion of a hole-punching punch 64 during its downward travel enter the space formed by the hole-punching punch 64 and die assist guide plates 68 (which correspond to the "punching dies" described in the claims), which may cause damage to the charge removal needles 163 and malfunction of the punching unit 60. For this reason, the protrusion length of the charge removal needles 163 is preferably set such that the distal ends of the charge removal needles 163 do not enter the above-mentioned space when the hole-punching punch 64 descends to the lowermost position and enters the space between the die assist guide plates 68.

Likewise, when the protrusion length of the charge removal needles 163 is considerable, the distal ends of the charge removal needles 163 entrained by the distal end portion of the hole-punching punch 64 during its upward travel enter the space above the lower paper guide 62*b*, i.e. the paper transport path, which may cause damage to the charge removal needles 163 and damage to punch holes in the paper, and may cause the punching unit 60 to malfunction. For this reason, the protrusion length of the charge removal needles 163 is preferably set such that they do not enter the space above the lower paper guide 62*b*, i.e. the paper transport path.

In addition, if the protrusion length of the charge removal needles 163 is considerable, another problem to address is the fact that the charge removal needles 163 are entrained by the upward travel of the hole-punching punch 64 during the ascent of the hole-punching punch 64 and undergo upwardly directed bending deformation.

Figure 16A:
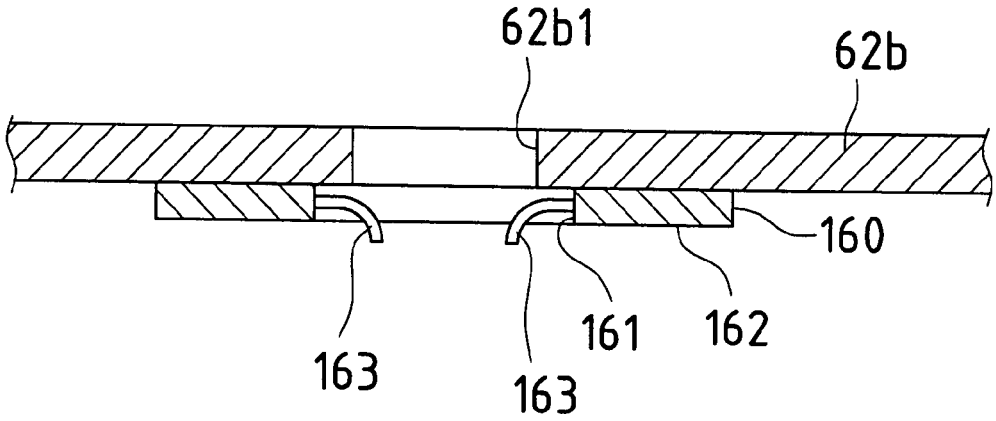
FIGS. 16(*a*) and 16(*b*) are explanatory views illustrating another arrangement of charge removal needles in the second embodiment.
Figure 16B:
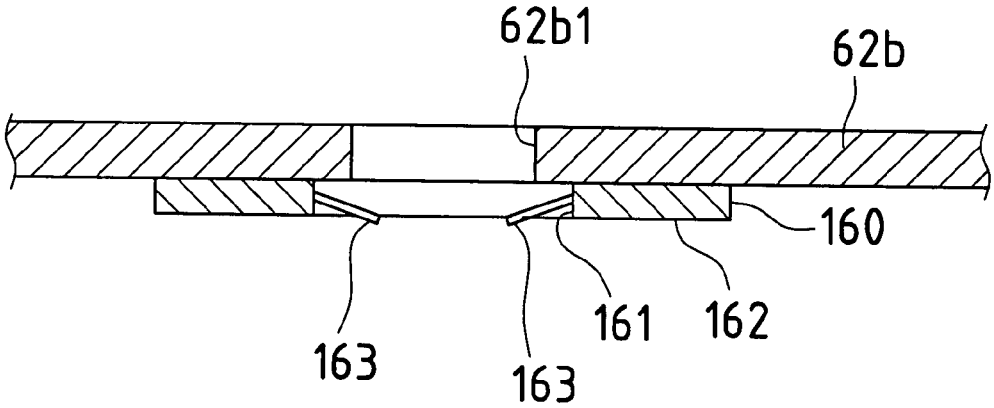
Figure 17:
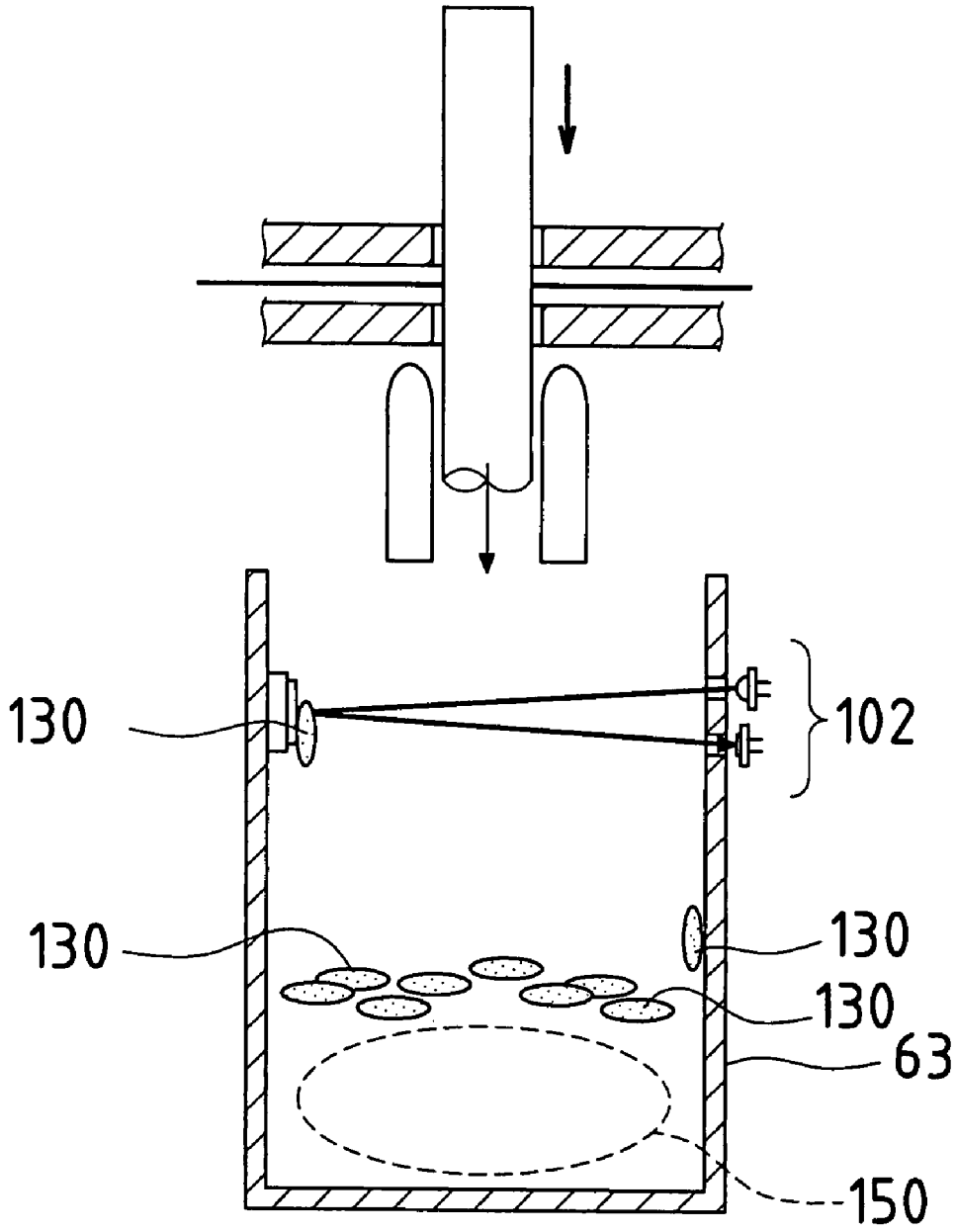
FIG.17 Conventional Art
FIG. 17 is an explanatory view illustrating collection of punch waste in a punch waste collecting container in a conventional punching apparatus.

Accordingly, in the second embodiment, as shown in FIG. 16(*a*), the charge removal needles 163 are imparted a curved shape, with their distal end portions hanging down. Moreover, as shown in FIG. 16(*b*), the charge removal needles 163 are provided at a downward slant. As a result of arranging the charge removal needles 163 in this manner, the contact between the charge removal needles 163 and hole-punching punch 64 becomes smoother even if the length of the charge removal needles 163 is rather long, and problems such as upward bending deformation of the charge removal needles 163 as a result of their entrainment by the hole-punching punch 64 during its ascent under the action of contact pressure forces do not occur. Moreover, providing the charge removal needles 163 in this manner can lengthen the contact distance (i.e. contact time) between the punch waste 130 and hole-punching punch 64 and, therefore, makes it possible to reliably produce charge removal effects.

It should be noted that in the second embodiment, as described above, since the punching die 65 and hole-punching punch 64 are positionally aligned based on values describing position in the paper width direction, as detected by the line sensor 36*f*, the shape of the opening portion 161 in the charge removal member 160 has to be a shape that takes into consideration the travel of the hole-punching punch 64 due to this positional alignment. For example, although in the above-mentioned embodiment the opening portion 161 is made circular, it may also be shaped as an ellipse etc. elongated in the paper width direction.

In addition to that, the charge removal member 160 may be constructed to permit movement in response to the positional alignment of the hole-punching dies 65 and hole-punching punch 64. For example, when the die assist guide plates 68 disposed facing the hole-punching punch 64 and hole-punching dies 65 have a mechanism structure whereby they travel integrally with the hole-punching punch 64 and hole-punching dies 65, the main body portion 162 of the charge removal member 160 can be disposed and secured to the upper ends of the die assist guide plates 68.

It should be noted that the present technology can be implemented in a variety of other forms without departing from its spirit or essential characteristics. For this reason, the above-described embodiments are to all intents and purposes merely illustrative and should not be construed as limiting. The scope of the present technology is defined by the Claims and is not restricted by the description of the Specification in any way. Furthermore, variations and modifications of the Claims within the scope of equivalency are all within the purview of the present technology.

What is claimed is:

1. A punching apparatus disposed along a transport path for image-formed paper, comprising:

a collecting container for collecting punch waste generated by punching the image-formed paper, and a charge removal member disposed in the collecting container and removing static electricity built up on the punch waste, wherein the charge removal member is disposed in a position corresponding to a hole-punching punch disposed inside the punching apparatus, and a distal end portion of the charge removal member is constituted by charge removal needles formed in the shape of comb teeth, and the spacing density of the charge removal needles in the portion corresponding to the hole-punching punch is higher than the spacing density of the charge removal needles in the portion corresponding to the periphery of the hole-punching punch, and wherein the charge removal needles are disposed at a first spacing permitting reliable capture of the charged punch waste in the portion corresponding to the hole-punching punch, and the charge removal needles are disposed at a second spacing in the portion corresponding to the periphery of the hole-punching punch so that punch waste that has been captured and destaticized by the charge removal needles disposed at the first spacing is allowed to fall under its own weight between the individual needles disposed at the second spacing.

2. An image forming apparatus comprising the punching apparatus of claim 1.

3. The punching apparatus according to claim 1, wherein the charge removal member is disposed in an open top portion of the collecting container.

4. The punching apparatus according to claim 1, wherein the charge removal member is disposed on the collecting container such that a proximal end portion of the charge removal member is supported on opposite edges of an open top portion of the collecting container, and the distal end portion of the charge removal member extends towards a central portion of the collecting container.

5. The punching apparatus according to claim 1, wherein the distal end portion of the charge removal member comprises:

a first portion that extends from a first side of the top of the collecting container towards the central portion of the collecting container; and a second portion that extends from a second side of the top of the collecting container which is opposite the first side, the second portion extending towards the central portion of the collecting container.

6. The punching apparatus according to claim 5, wherein a gap is maintained between ends of the charge removal needles on the first portion and ends of the charge removal needles on the second portion.

7. The punching apparatus according to claim 1, wherein each of the charge removal needles comprises a unitary piece of electrically conductive material.

8. The punching apparatus according to claim 1, wherein the charge removal member is grounded through a frame of the apparatus.

* * * * *